US011807972B2

(12) United States Patent
Iida et al.

(10) Patent No.: US 11,807,972 B2
(45) Date of Patent: Nov. 7, 2023

(54) EMBROIDERY FRAME AND PRESSER MEMBER

(71) Applicant: BROTHER KOGYO KABUSHIKI KAISHA, Nagoya (JP)

(72) Inventors: Mitsuhiro Iida, Gifu (JP); Takahira Osamura, Kitanagoya (JP); Akihiro Hibino, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 137 days.

(21) Appl. No.: 17/199,175

(22) Filed: Mar. 11, 2021

(65) Prior Publication Data

US 2022/0098774 A1 Mar. 31, 2022

(30) Foreign Application Priority Data

Sep. 30, 2020 (JP) ..... 2020-166337

(51) Int. Cl.
*D05C 9/04* (2006.01)

(52) U.S. Cl.
CPC ..... *D05C 9/04* (2013.01); *D05D 2207/06* (2013.01)

(58) Field of Classification Search
CPC ... D05C 1/04; D05C 1/02; D05C 9/10; D05C 9/04; D05B 31/00; D05B 39/00; D05B 39/005
USPC ..... 38/102.2; 112/103
See application file for complete search history.

(56) References Cited

U.S. PATENT DOCUMENTS

| | | | |
|---|---|---|---|
| 1,434,898 | A | 11/1922 | Koller |
| 2,007,819 | A | 7/1935 | Tillett |
| 3,730,116 | A | 5/1973 | Schramayr |
| 4,275,673 | A | 6/1981 | Boser et al. |
| 4,854,251 | A | 8/1989 | Hiramatsu et al. |
| 5,218,915 | A | 6/1993 | Iwasaki et al. |

(Continued)

FOREIGN PATENT DOCUMENTS

| | | | |
|---|---|---|---|
| JP | H11-061627 | A | 3/1999 |
| JP | 2010-82017 | A | 4/2010 |

(Continued)

OTHER PUBLICATIONS

U.S. Appl. No. 17/199,063, filed Mar. 11, 2021 in the name of Osamura et al.
Aug. 3, 2022 Office Action issued in U.S. Appl. No. 17/199,063.

*Primary Examiner* — Patrick J. Lynch
(74) *Attorney, Agent, or Firm* — Oliff PLC

(57) ABSTRACT

An embroidery frame includes a base frame including a magnetic body, and a presser member configured to press a sewing object toward the base frame. The presser member includes a main body portion and a lever. The main body portion includes an opposing surface facing the base frame and a magnet. The lever includes a support portion, a point of application portion, and an operation portion. The support portion is rotatably supported on the main body portion to rotate around a rotational center. The point of application portion is provided on one end side of the lever with respect to the rotational center. The point of application portion is pivotable from a stand-by position to an application position in accordance with the operation portion being operated to the first side in a state where the presser member is disposed on the base frame.

12 Claims, 15 Drawing Sheets

(56) References Cited

U.S. PATENT DOCUMENTS

| | | | | |
|---|---|---|---|---|
| 5,353,725 | A * | 10/1994 | Sakakibara | D05C 9/04 112/470.14 |
| 6,679,190 | B1 * | 1/2004 | French | D05C 9/04 112/103 |
| 7,377,222 | B1 | 5/2008 | Moore, III | |
| 2007/0079741 | A1 | 4/2007 | Watanabe et al. | |
| 2008/0276849 | A1 * | 11/2008 | Mack | D05C 9/04 112/103 |
| 2009/0267277 | A1 * | 10/2009 | Mack | D05C 9/04 269/8 |
| 2012/0060732 | A1 | 3/2012 | Viltrakis et al. | |
| 2018/0320301 | A1 | 11/2018 | Kawaguchi et al. | |
| 2020/0024783 | A1 * | 1/2020 | Ueda | D05C 9/04 |

FOREIGN PATENT DOCUMENTS

| | | | | |
|---|---|---|---|---|
| JP | 2017-148382 | A | 8/2017 | |
| WO | WO-2005121431 | A1 * | 12/2005 | D05B 39/00 |

* cited by examiner

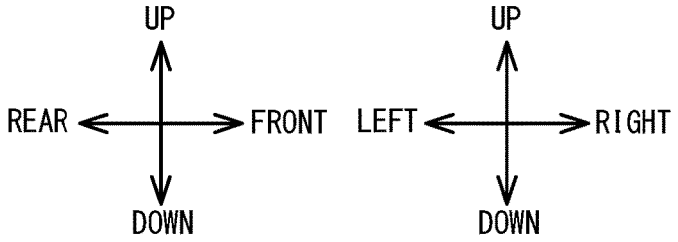
FIG. 12A
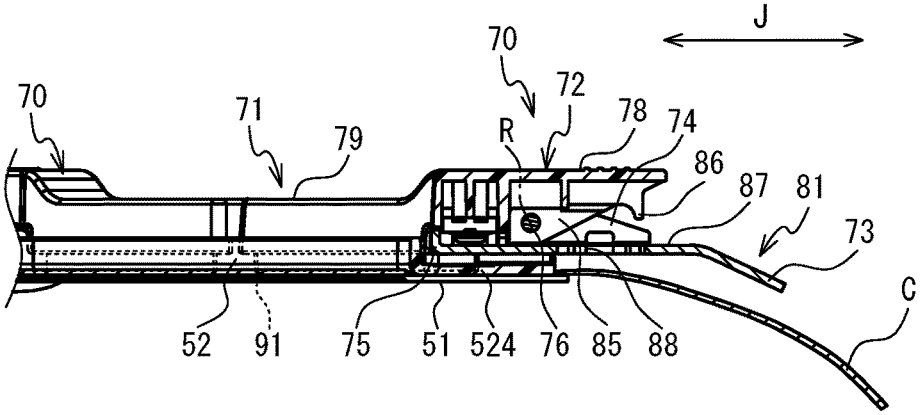
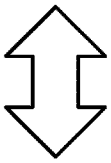
FIG. 12B
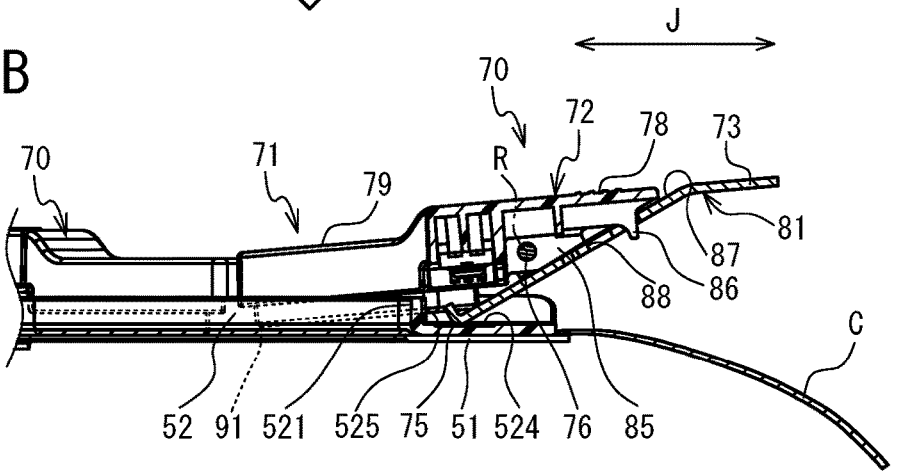

EMBROIDERY FRAME AND PRESSER MEMBER

CROSS-REFERENCE TO RELATED APPLICATION

This application claims priority to Japanese Patent Application No. 2020-166337 filed Sep. 30, 2020, the content of which is hereby incorporated herein by reference in its entirety.

BACKGROUND

The present disclosure relates to an embroidery frame and a presser member.

An embroidery frame is known that can be mounted on an embroidery sewing machine. The embroidery frame of known art is provided with a frame body and a holding assembly. The holding assembly includes a magnet, and can be removably attached to the frame body using a magnetic force. The embroidery frame clamps a sewing object between the frame body and the holding assembly.

SUMMARY

The embroidery frame that clamps the sewing object using the magnetic force is preferably provided with the holding assembly having a strong magnetic force so that the sewing object does not become displaced with respect to the embroidery frame during embroidery sewing. However, the stronger the magnetic force of the holding assembly, the greater a force necessary to remove the holding assembly from the frame body.

Embodiments of the broad principles derived herein provide an embroidery frame and a presser member capable of holding, using a magnetic force of a magnet provided in the presser member, a sewing object disposed between a base frame and the presser member, and with which an operation to remove the presser member from the base frame is easier than in known art.

Embodiments provide an embroidery frame that includes a base frame including a magnetic body, and a presser member configured to press a sewing object disposed between the presser member and the base frame toward the base frame, using a magnetic force. The presser member includes a main body portion and a lever. The main body portion includes an opposing surface facing the base frame and a magnet. The lever is provided with a support portion, a point of application portion, and an operation portion. The support portion is rotatably supported on the main body portion to rotate around a rotational center. The point of application portion is provided on one end side of the lever with respect to the rotational center. The point of application portion is pivotable to a stand-by position and an application position when the presser member is disposed on the base frame. The stand-by position is a position where the point of application portion is on a first side separated further from the base frame than the opposing surface. The application position is a position where the point of application portion is on a second side closer to the base frame than in the stand-by position. The operation portion is provided on another end side of the lever with respect to the rotational center. The other end side is the opposite side from the one end side, and the operation portion moves the point of application portion from the stand-by position to the application position in accordance with the operation portion being operated to the first side in a state where the presser member is disposed on the base frame, to move at least a part of the main body portion to the first side in resistance to a magnetic force of the magnet.

Embodiments further provide a presser member that includes a main body portion including an opposing surface facing the base frame and a magnet, and a lever being provided with a support portion, a point of application portion, and an operation portion. The support portion is rotatably supported on the main body portion to rotate around a rotational center. The point of application portion is provided on one end side of the lever with respect to the rotational center. The point of application portion is pivotable to a stand-by position and an application position when the presser member is disposed on the base frame. The stand-by position is a position where the point of application portion is on a first side separated further from the base frame than the opposing surface. The application position is a position where the point of application portion is on a second side closer to the base frame than in the stand-by position. The operation portion is provided on another end side of the lever with respect to the rotational center. The other end side is the opposite side from the one end side, and the operation portion moves the point of application portion from the stand-by position to the application position in accordance with the operation portion being operated to the first side in a state where the presser member is disposed on the base frame, to move at least a part of the main body portion to the first side in resistance to a magnetic force of the magnet.

BRIEF DESCRIPTION OF THE DRAWINGS

Embodiments will be described below in detail with reference to the accompanying drawings in which:

FIG. 12A is a cross-sectional view of the presser member in the direction of arrows along a line G-G shown in FIG. 8A, in a state in which the point of application portion is in the stand-by position, and FIG. 12B a cross-sectional view of the presser member in the direction of the arrows along the line G-G shown in FIG. 8A, in a state in which the point of application portion is in the application position;

DETAILED DESCRIPTION

Figure 1:
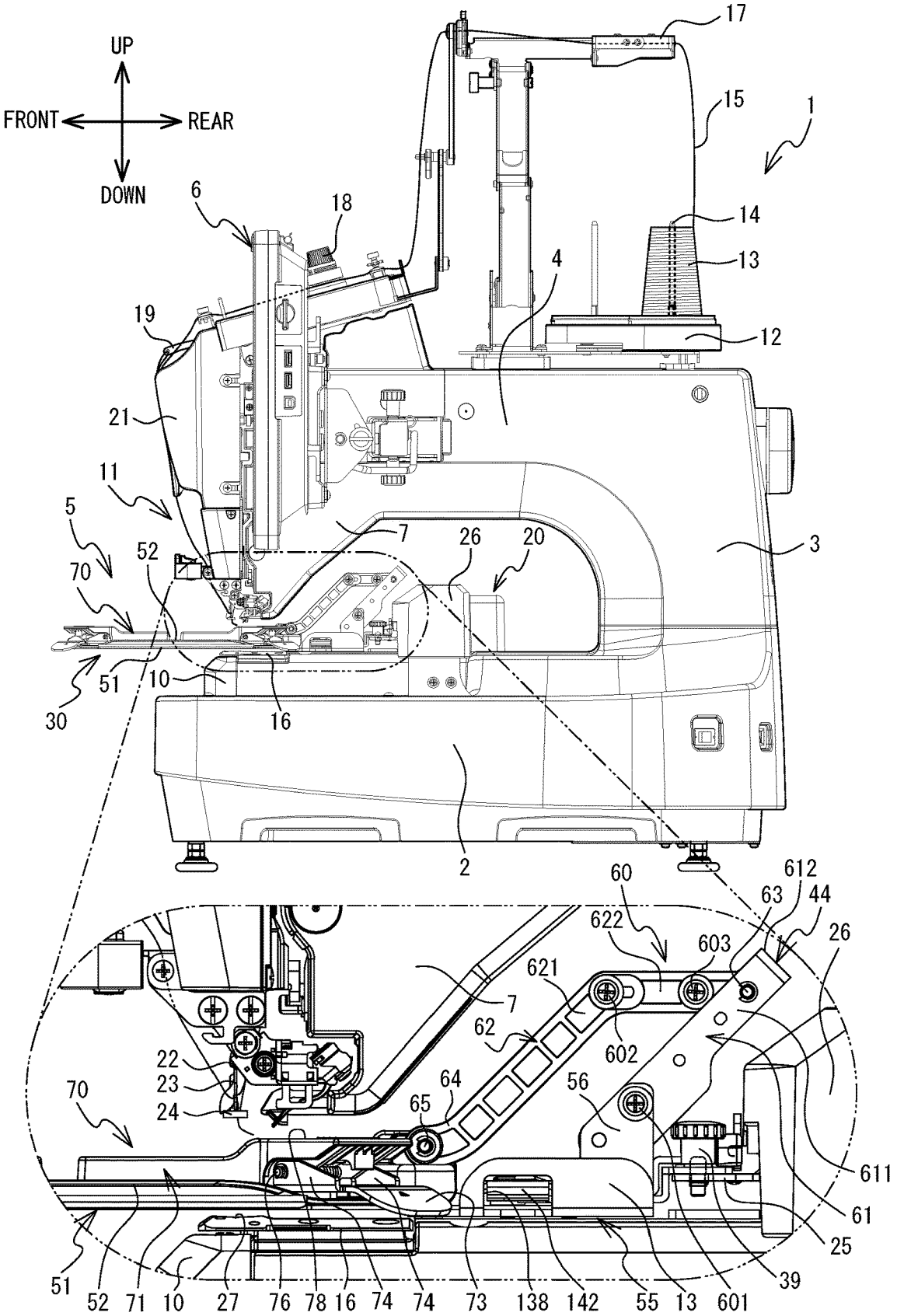
FIG. 1 is a right-side view of a sewing machine on which an embroidery frame is mounted.
Figure 2:
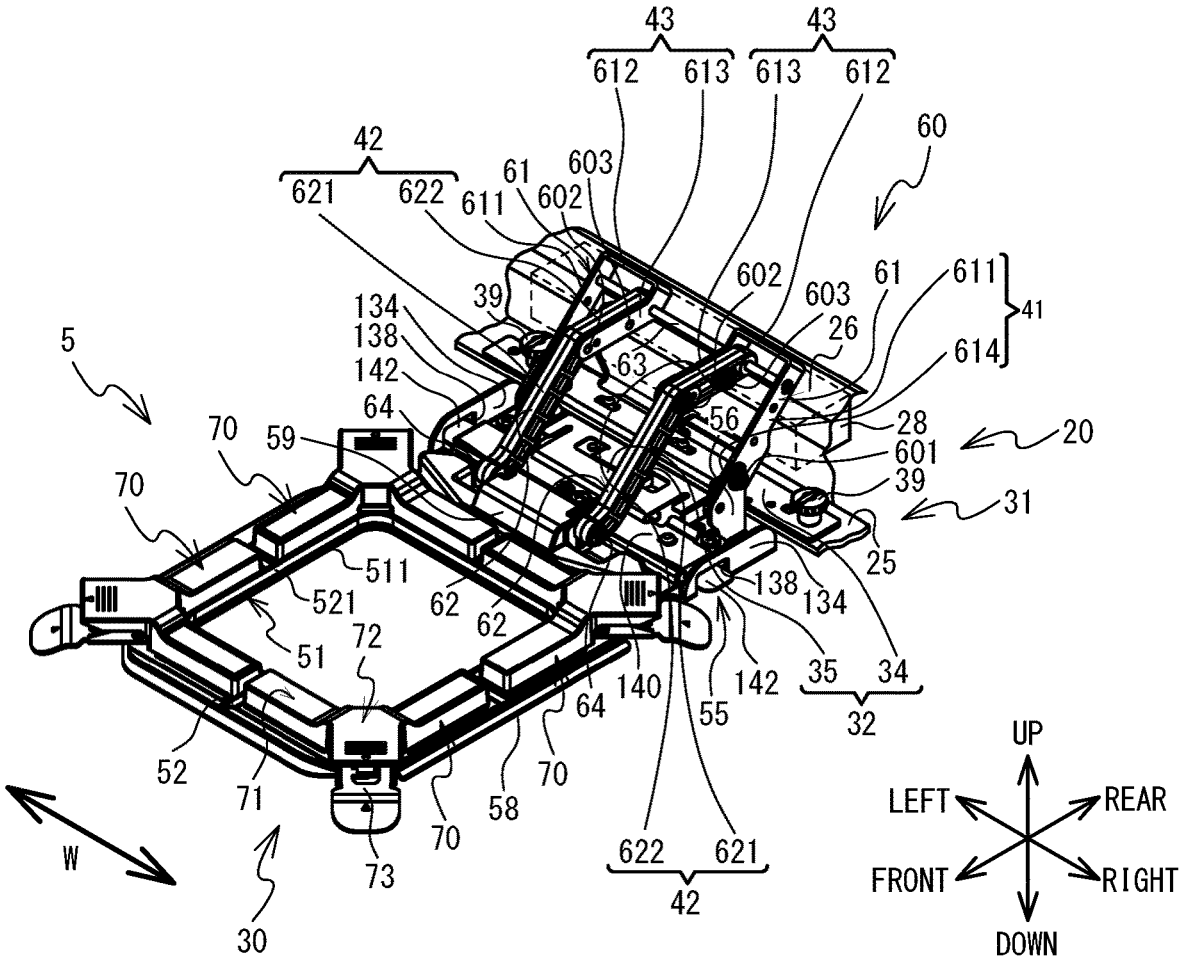
FIG. 2 is a perspective view of an embroidery frame unit mounted on a holder.

Hereinafter, a first and a second embodiment of the present disclosure will be explained with reference to the drawings. With reference to FIG. 1 and FIG. 2, a physical configuration of a multi-needle sewing machine (hereinafter referred to simply as sewing machine) 1, and an embroidery frame 5 will be explained. In the following explanation, the upper side, the lower side, the left side, and the right side in FIG. 1 are, respectively, the upper side, the lower side, the front side, and the rear side of the sewing machine 1 and the embroidery frame 5. An actual scale of mechanical elements in the drawings in the present embodiment is contracted as appropriate.

As shown in FIG. 1, the sewing machine 1 is provided with a support portion 2, a pillar 3, and an arm portion 4. The support portion 2 supports the whole of the sewing machine 1. The pillar 3 is provided standing upward from the rear end portion of the support portion 2. The arm portion 4 extends toward the front from the upper end portion of the pillar 3. A needle bar case 21 is mounted on a head portion 7 provided on the leading end of the arm portion 4 such that the needle bar case 21 can move in the left-right direction. Ten needle bars 22 that extend in the up-down direction are provided inside the needle bar case 21, the needle bars 22 being arranged at uniform intervals in the left-right direction. Of the ten needle bars 22, a sewing portion 11 drives one of the needle bars 22 that is in a sewing position, using a drive shaft motor (not shown in the drawings) as a drive source, and causes the one needle bar 22 to move slidingly up and down. A sewing needle 23 can be mounted on the lower end of the needle bar 22. A presser foot 24 intermittently presses a sewing object C (refer to FIG. 8) downward, in concert with the up and down sliding movement of the needle bar 22. The sewing object C is, for example, a sheet-shaped processing cloth, a piece of leather, a resin sheet or the like.

An operation portion 6 is provided in the arm portion 4. A cylindrical cylinder bed 10 that extends to the front from the lower end portion of the pillar 3 is provided below the arm portion 4. A needle plate 16, which is rectangular in a plan view, is provided in the upper surface of the cylinder bed 10. A needle hole 27, through which the sewing needle 23 is inserted, is provided in the needle plate 16. A shuttle (not shown in the drawings) is provided inside the leading end portion of the cylinder bed 10. The shuttle houses a bobbin (not shown in the drawings) around which a lower thread (not shown in the drawings) is wound. A shuttle drive mechanism (not shown in the drawings) is provided inside the cylinder bed 10. The shuttle drive mechanism drives the shuttle to rotate. Further, a holder 25, a Y carriage 26, and an X carriage 28 (refer to FIG. 2) of a movement portion 20 are provided below the arm portion 4. As shown in FIG. 2, the holder 25 of the movement portion 20 supports the embroidery frame 5 via a frame attachment member 31. The movement portion 20 can move the embroidery frame 5 mounted on the holder 25 to a position indicated by a unique XY coordinate system (embroidery coordinate system). As shown in FIG. 1, a pair of left and right thread spool bases 12 are provided on the rear side of the upper surface of the arm portion 4. A plurality of thread spool pins 14 are provided on each of the thread spool bases 12. The thread spool pin 14 supports a thread spool 13. An upper thread 15 is supplied from the thread spool 13 installed on the thread spool base 12. The upper thread 15 is supplied to an eye (not shown in the drawings) of each of the sewing needles 23 mounted on the lower ends of the needle bars 22, via a thread path. The thread path includes a thread guide 17, a tensioner 18, and a thread take-up lever 19.

An operation to form stitches in the sewing object C held by the embroidery frame 5 will be explained with reference to FIG. 1 and FIG. 2. The embroidery frame 5 that holds the sewing object C is supported on the holder 25 of the movement portion 20, via the frame attachment member 31. As a result of the needle bar case 21 moving to the left and the right, one of the ten needle bars 22 is selected as the needle bar 22 used for the sewing. The embroidery frame 5 is moved to a predetermined position by the movement portion 20. Using the drive shaft motor as a drive source, the sewing portion 11 drives the selected needle bar 22 and the corresponding thread take-up lever 19 up and down. Further, the shuttle drive mechanism is driven by the rotation of the drive shaft motor and the shuttle is driven to rotate. In this way, the sewing needle 23, the thread take-up lever 19, and the shuttle are driven in synchronization with each other, and the stitches are formed in the sewing object C.

Figure 3:
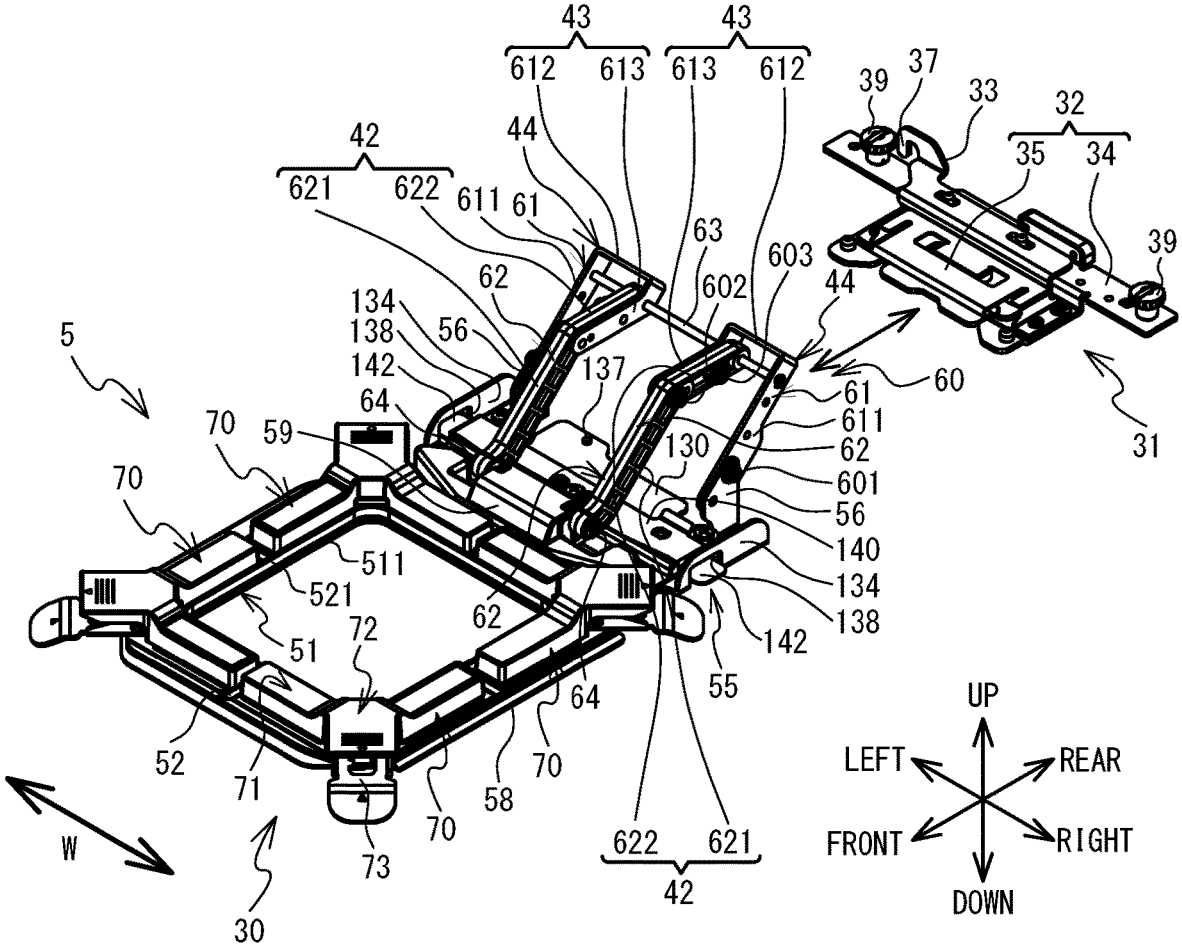
FIG. 3 is a perspective view of the embroidery frame unit in a state in which the embroidery frame is removed from a frame attachment member.

An embroidery frame unit 30 will be explained with reference to FIG. 2 to FIG. 12. As shown in FIG. 1 to FIG. 3, the embroidery frame unit 30 is a member that is removably mounted on the sewing machine 1. The embroidery frame unit 30 is provided with the embroidery frame 5 and the frame attachment member 31. The embroidery frame 5 is provided with a base frame 51, an opposing frame 52, presser members 70, a mounting portion 55, and a support member 60. The sewing object C can be held between the base frame 51 and the opposing frame 52 using magnetic force. The frame attachment member 31 is removably mounted on the holder 25 of the sewing machine 1. The embroidery frame 5 is removably mounted on the frame attachment member 31. In other words, the embroidery frame 5 can be mounted on the sewing machine 1 of the present embodiment via the frame attachment member 31. FIG. 1 and FIG. 2 show a state in which the embroidery frame 5 is mounted on the frame attachment member 31. FIG. 3 illustrates a state in which the embroidery frame 5 is removed from the frame attachment member 31. Hereinafter, a configuration of the embroidery frame 5 will be explained while taking a posture of the embroidery frame 5 when the embroidery frame 5 is mounted on the sewing machine 1 via the frame attachment member 31 as a reference.

Figure 4A:
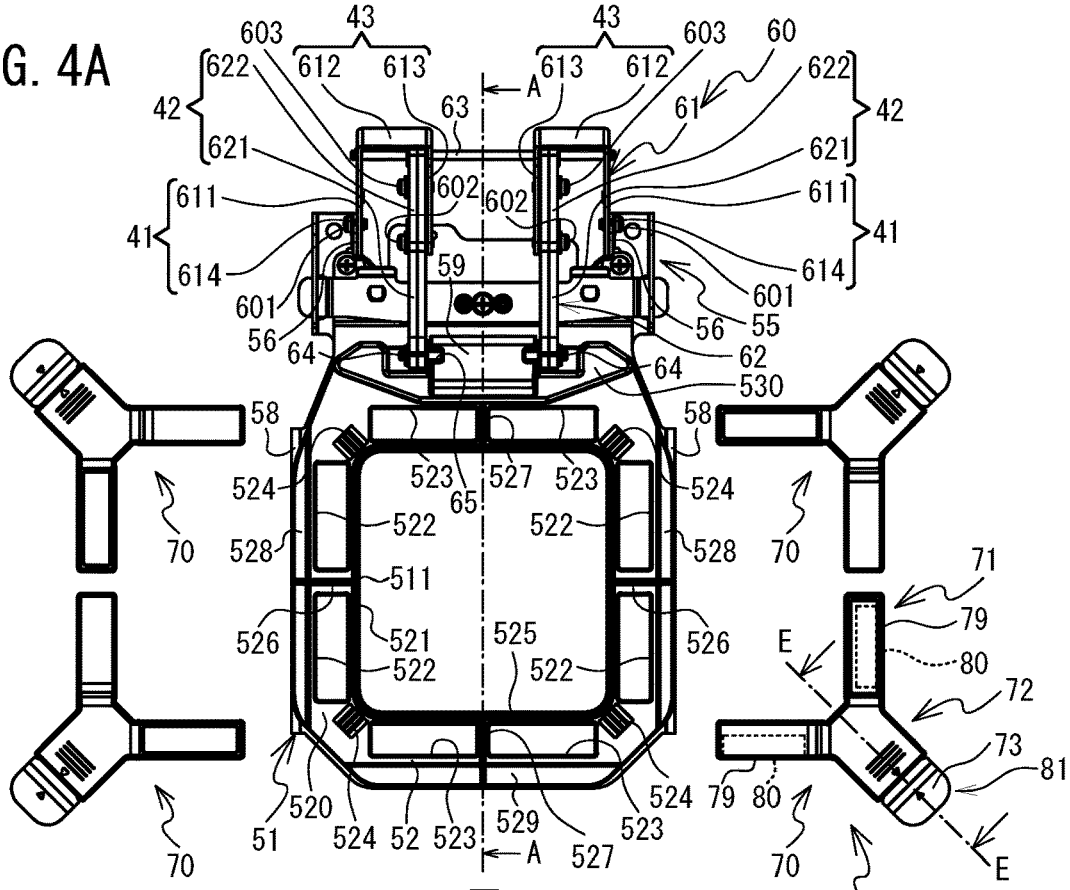
FIG. 4A is a plan view of the embroidery frame in a state in which four presser members are removed from a base frame.
Figure 4B:
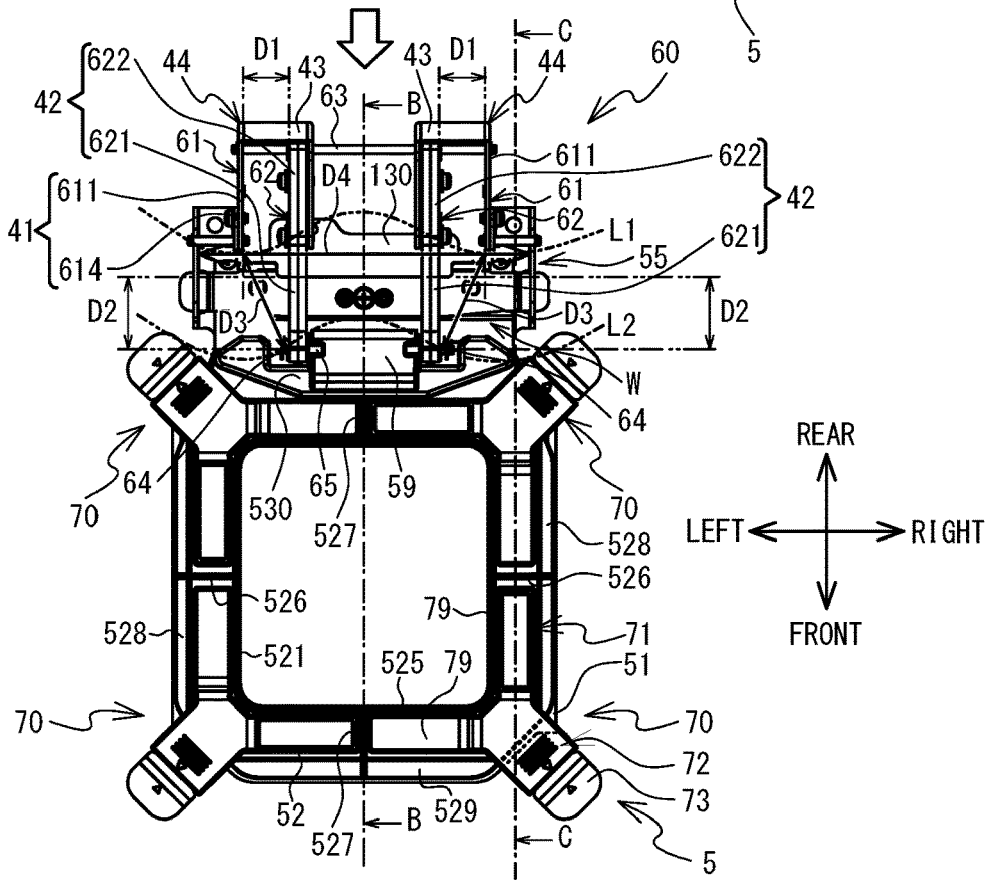
FIG. 4B is a plan view of the embroidery frame in a state in which the four presser members are disposed on the base frame.

As shown in FIG. 3, FIG. 4A and FIG. 4B, the embroidery frame 5 is substantially left-right symmetrical with respect to a center line in the left-right direction (a line A-A shown in FIG. 4A and a line B-B shown in FIG. 4B). In a plan view, the base frame 51 is a rectangular frame shape in which an opening 511 is formed that penetrates the base frame 51 in the up-down direction. At least the upper surface of the base frame 51 includes a magnetic body that is positioned facing magnets 80 of the presser members 70 to be described later. The magnetic body is a metal, such as stainless steel, for example. The base frame 51 of the present embodiment is formed entirely of the magnetic body. In a state in which the sewing object C is disposed between the base frame 51 and the opposing frame 52, the sewing object C is placed on the upper surface of the base frame 51. The base frame 51 is provided with a pair of left and right bent portions 58. Each of the pair of bent portions 58 is a portion at which both end portions, on the left and the right, of the base frame 51 are bent upward. The rear end portion of the base frame 51 is coupled to the front side portion of an attachment member 130 of the mounting portion 55 to be described later. In the present embodiment, the base frame 51 and the attachment member 130 are formed integrally by the magnetic body that is the stainless steel or the like.

The opposing frame 52 is disposed above the base frame 51, and the embroidery frame 5 can hold the sewing object C that is disposed between the base frame 51 and the opposing frame 52. As described below, the opposing frame 52 is rotatably supported with respect to the base frame 51, and below, the configuration of the opposing frame 52 will be explained taking a state in which the opposing frame 52 is closed with respect to the base frame 51 as a reference. In a plan view, the opposing frame 52 is a rectangular frame shape in which an opening 521 is formed that penetrates the opposing frame 52 in the up-down direction. In a state in which the base frame 51 and the opposing frame 52 are overlaid in the up-down direction, a plan view shape of the opening 511 and of the opening 521 are mutually aligned. As shown in FIG. 4A, two sets of pairs of holes 522, and two sets of pairs of holes 523, which penetrate the opposing frame 52 in the up-down direction, are provided in the opposing frame 52 of the present embodiment. One set of the pairs of holes 522 are aligned in the front-rear direction on a left side portion of the opposing frame 52. The other set of the pairs of holes 522 are aligned in the front-rear direction on a right side portion of the opposing frame 52. Each of the holes 522 is a rectangular shape that is long in the front-rear direction in a plan view. In a similar manner, one of the sets of the pair of holes 523 are aligned in the left-right direction in a front side portion of the opposing frame 52. The other set of the pair of holes 523 are aligned in the left-right direction in a rear side portion of the opposing frame 52. Each of the holes 523 is a rectangular shape that is long in the left-right direction in a plan view.

The opposing frame 52 is provided with an upper surface 520, four corner portions 524, a wall portion 525, a pair of left and right partitioning portions 526, a pair of front and rear partitioning portions 527, a pair of left and right guide portions 528, a front guide portion 529, a rear guide portion 530, and an insertion portion 59. Each of the corner portions 524 has a flat plate shape disposed in the four corners of the opposing frame 52, and each faces the base frame 51 in the up-down direction. The wall portion 525 protrudes upward from the upper surface 520 of the opposing frame 52, at the end portions on an inner peripheral side of the opposing frame 52. Each of the pair of left and right partitioning portions 526 is a convex portion that extends in the left-right direction and protrudes higher than the upper surface 520, at a center portion in the front-rear direction of the left side portion of the opposing frame 52 and at a center portion in the front-rear direction of the right side portion of the opposing frame 52. In the front-rear direction, each of the left and right partitioning portions 526 is provided between the corresponding pair of holes 522. Each of the pair of front and rear partitioning portions 527 is a convex portion that extends in the front-rear direction and protrudes higher than the upper surface 520, at a center portion in the left-right direction of the front side portion of the opposing frame 52 and at a center portion in the left-right direction of the rear side portion of the opposing frame 52. In the left-right direction, each of the front and rear partitioning portions 527 is provided between the corresponding pair of holes 523.

Each of the pair of left and right guide portions 528 extends in the front-rear direction at both of end portions on the left and right of the opposing frame 52. The front guide portion 529 extends in the left-right direction at the front side portion of the opposing frame 52. The pair of left and right guide portions 528 and the front guide portion 529 are inclined upward as they separate from the opening 521. The rear guide portion 530 extends in the left-right direction at the rear end portion of the opposing frame 52, and is provided standing upward from the upper surface 520 of the opposing frame 52. The pair of holes 522 in the left side portion are formed between the left guide portion 528 and the wall portion 525 in the left-right direction. The pair of holes 522 in the right side portion are formed between the right guide portion 528 and the wall portion 525 in the left-right direction. The pair of holes 523 in the front side portion are formed between the front guide portion 529 and the wall portion 525. The pair of holes 523 in the rear side portion are formed between the rear guide portion 530 and the wall portion 525.

Figure 5:
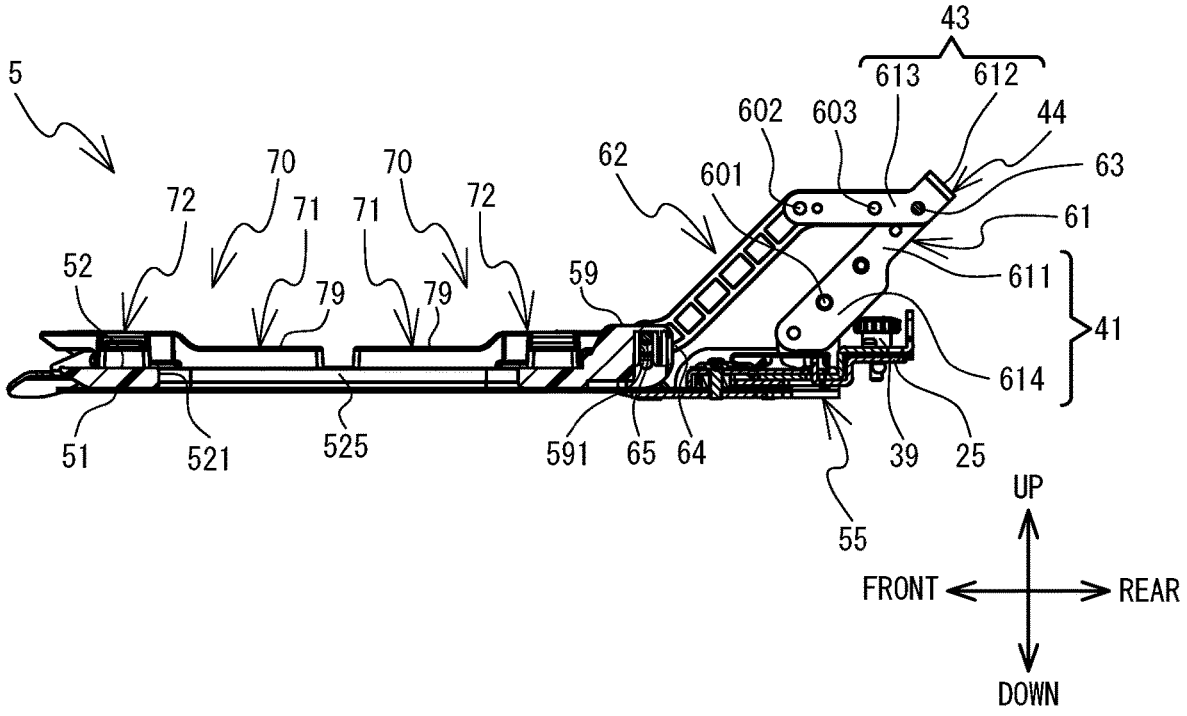
FIG. 5 is an enlarged view corresponding to a cross section in a direction of arrows along a line B-B shown in FIG. 4B.

As shown in FIG. 5, the insertion portion 59 is provided in the rear guide portion 530, and includes a long hole 591 that is long in the up-down direction and penetrates in the left-right direction. The insertion portion 59 positions the opposing frame 52 with respect to the base frame 51 in the left-right direction and the front-rear direction.

Figure 9:
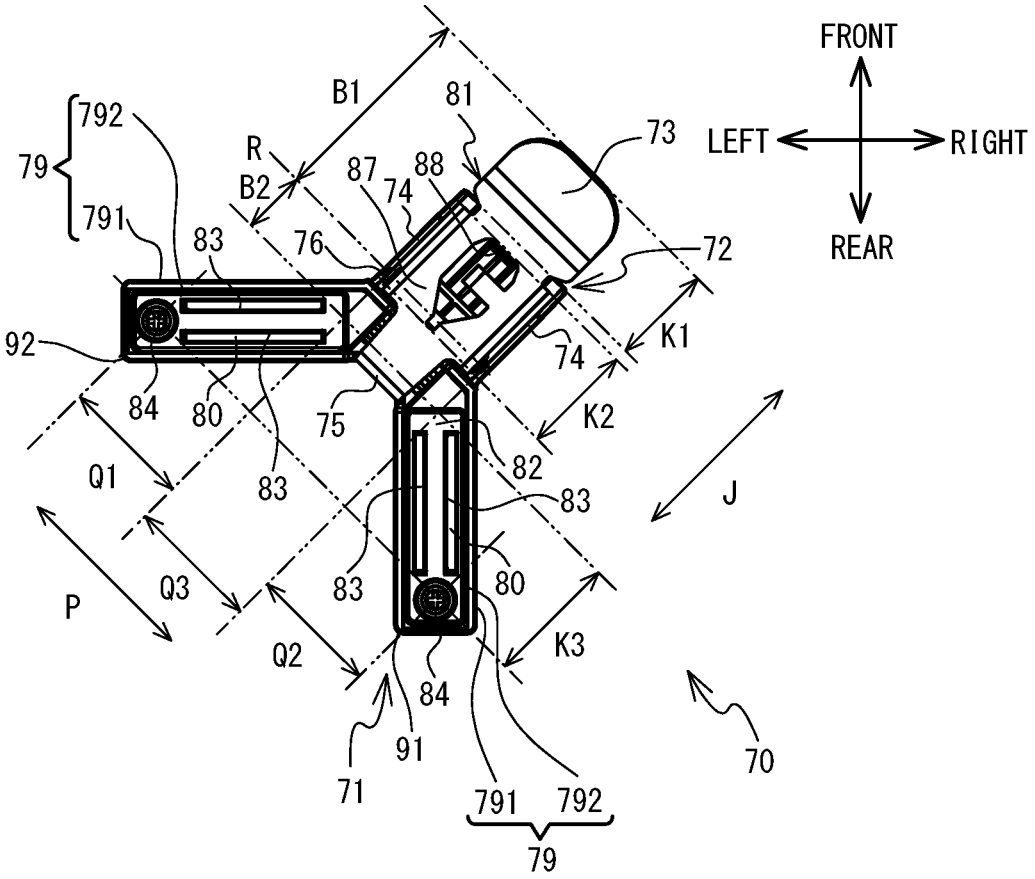
FIG. 9 is an enlarged view, from below, of the presser members.
Figure 10:
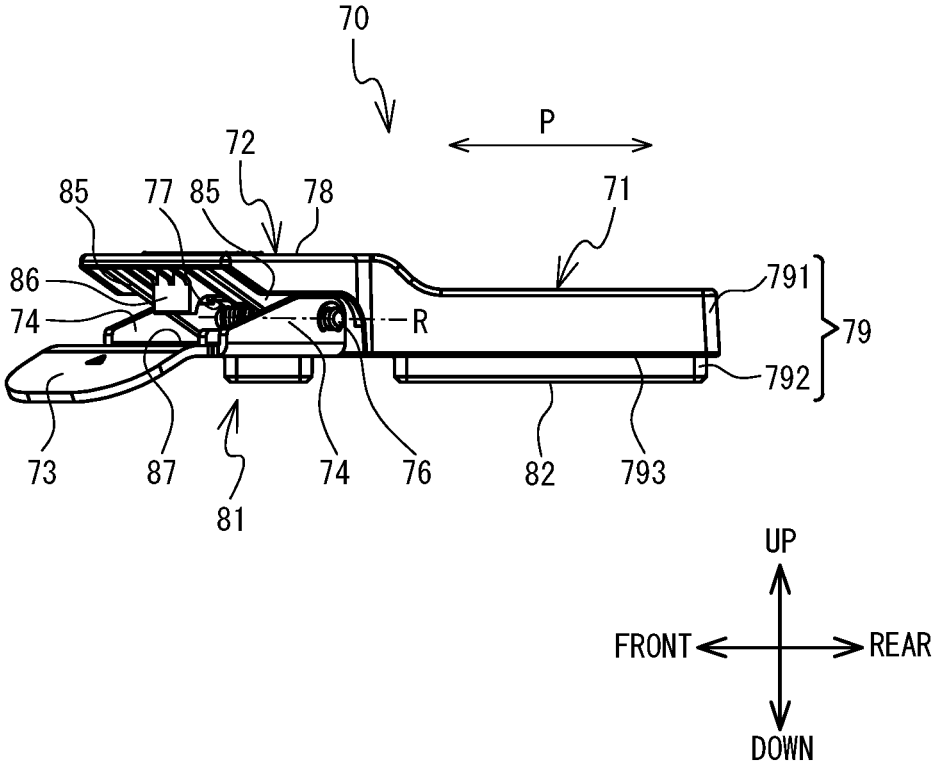
FIG. 10 is a right-side enlarged view of the presser member.

As shown in FIG. 4A and FIG. 4B, the four presser members 70 use magnetic force to press the sewing object C disposed between the base frame 51 and presser members 70 to the base frame 51 side. Since a shape of each of the four presser members 70 is mutually the same, a configuration will be explained of the presser member 70 using, as a reference, a case in which the presser member 70 disposed in a position including the corner portion 524 on the front right of the base frame 51 is disposed with respect to the base frame 51. An explanation of the other three presser members 70 will be omitted. The presser member 70 is provided with a main body portion 71 and a lever 81. The main body portion 71 has a Y shape in a plan view, and is provided with a pair of housing portions 79, a pair of the magnets 80, and a support portion 72. The pair of housing portions 79 are provided so as to be symmetrical with respect to a line E-E shown in FIG. 4A, and each has a box shape. The housing portion 79 to the left of the line E-E is a cuboid shape that is long in the left-right direction, and the housing portion 79 to the right of the line E-E is a cuboid shape that is long in the front-rear direction. As shown in FIG. 10, each of the housing portions 79 is provided with an upper portion 791 and an insertion portion 792. The insertion portion 792 is a portion that protrudes downward from a bottom surface 793 of the upper portion 791. As shown in FIG. 9, in a bottom view, a contour of the insertion portion 792 is disposed on the inside of a contour of the upper portion 791. A bottom surface of the insertion portion 792 is an opposing surface 82 that faces the base frame 51. On the opposing surface 82 of each of the housing portions 79, a pair of slits 83 are formed that extend in the lengthwise direction of the housing portion 79. The pair of slits 83 are aligned so as to be separated from each other in a short direction of the housing portion 79.

As shown in FIG. 4A and FIG. 4B, when the presser member 70 is disposed on the base frame 51, the insertion portions 792 of the pair of housing portions 79 are respectively inserted into the holes 522 and 523 adjacent to the corresponding corner portion 524 of the opposing frame 52. The bottom surface 793 of the upper portion 791 comes into contact with the upper surface 520 of the opposing frame 52. The housing portion 79 to the left of the line E-E is disposed between the front guide portion 529 and the wall portion 525 in the front-rear direction and, in the left-right direction, is disposed between the partitioning portion 527 of the front side portion of the opposing frame 52 and the corner portion 524 of the front right portion of the opposing frame 52. The housing portion 79 to the right of the line E-E is disposed between the right guide portion 528 and the wall portion 525 in the left-right direction and, in the front-rear direction, is disposed between the partitioning portion 526 of the right side portion of the opposing frame 52 and the corner portion 524 of the front right portion of the opposing frame 52.

Figure 6:
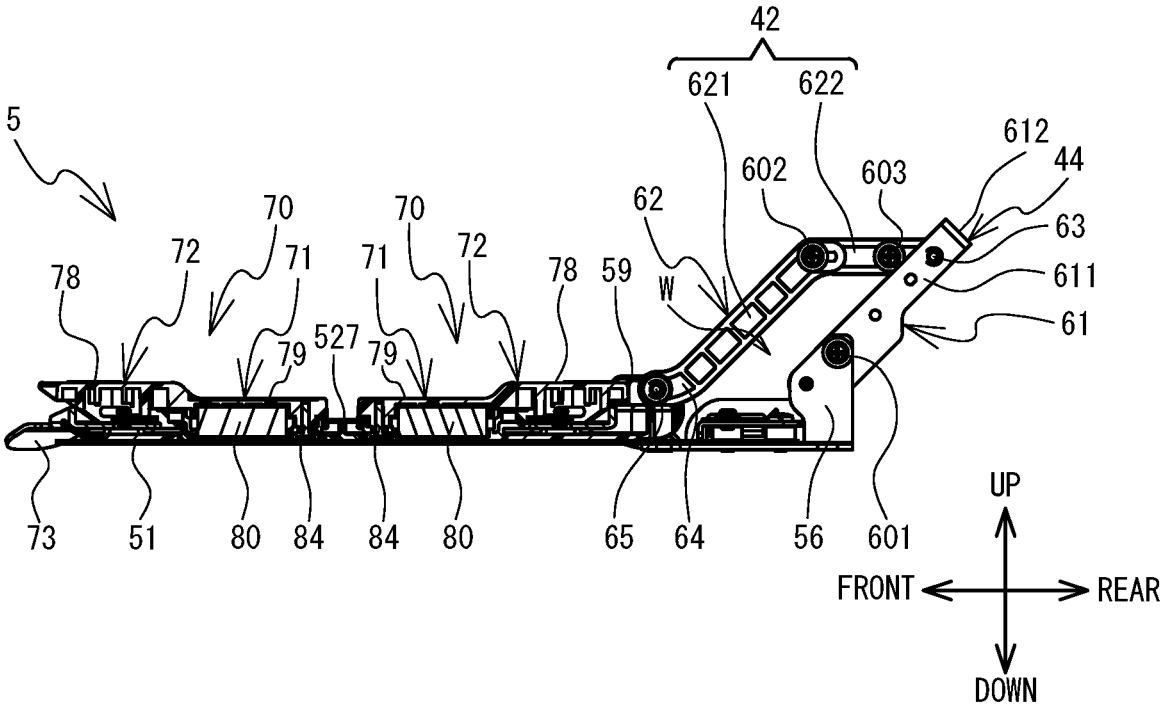
FIG. 6 is an enlarged view of a cross section in a direction of arrows along a line C-C shown in FIG. 4B.

As shown in FIG. 6, each of the pair of magnets 80 is a cuboid magnet that is housed so as to extend through the upper portion 791 and the insertion portion 792 of the corresponding housing portion 79. The presser member 70 may be provided with a yoke that guides the magnetic flux generated by the magnet 80. The magnet 80 is fixed to the housing portion 79 by a screw 84 that extends in the up-down direction and is inserted through the opposing surface 82 of the housing portion 79.

As shown in FIG. 4A, the support portion 72 is centered on the line E-E and extends along the line E-E. The support portion 72 couples the right end of the housing portion 79 to the left of the line E-E with the front end of the housing portion 79 to the right of the line E-E. As shown in FIG. 9 and FIG. 10, the support portion 72 is provided with a contact portion 78, a pair of support plate portions 85, a rotating shaft 76, an urging member 77, and a convex portion 86. The contact portion 78 is provided on a side of the main body portion 71 opposite to the opposing surface 82 that faces the magnet 80, that is, on the upper side of the main body portion 71. In the up-down direction, the upper surface of the contact portion 78 is higher than the upper surfaces of the pair of housing portions 79. In an extending direction P of the rotating shaft 76 (a rotational center R), each of the pair of support plate portions 85 extends downward from between the respective end portions of the contact portion 78 and the center of the contact portion 78 in the extending direction P of the rotating shaft 76. The further to the front right portion side, the smaller a downward protrusion amount of each of the pair of support plate portions 85. In each of the pair of support plate portions 85, a hole is formed that penetrates the support plate portion 85 in the thickness direction and through which the rotating shaft 76 is inserted. The rotating shaft 76 extends in a direction perpendicular to the line E-E and parallel to an extending surface of the base frame 51 (the extending direction P). The rotating shaft 76 is cylindrically shaped and an axial center thereof is the rotational center R of the lever 81. The rotating shaft 76 is inserted into the urging member 77. The urging member 77 is, for example, a torsion spring. Of the bottom surface of the contact portion 78, the convex portion 86 protrudes downward from a center portion of the extending direction P of the rotating shaft 76. The convex portion 86 prevents an operating body, such as a finger of a user and the like, from entering between the contact portion 78 and the lever 81.

The lever 81 is a plate-shaped member that extends along the line E-E shown in FIG. 4A. As shown in FIG. 9 to FIG. 12, the lever 81 is provided with a pair of support portions 74, a point of application portion 75, and an operation portion 73. A hole 88 that penetrates in the thickness direction is formed in the lever 81. The pair of support portions 74 are rotatably supported around the rotational center R that is the axial center of the rotating shaft 76, below the contact portion 78 of the main body portion 71. The pair of support portions 74 are portions obtained by upwardly bending both of end portions, in the extending direction P of the rotating shaft 76, of the lever 81 that is provided between the point of application portion 75 and the operation portion 73 in an extending direction J of the lever 81. The extending direction J of the lever 81 is orthogonal to the extending direction P of the rotating shaft 76. An upwardly protruding amount of each of the pair of support portions 74 from a portion 87 between the point of application portion 75 and the operation portion 73 becomes smaller the further toward the front right side. A hole that penetrates in the extending direction P of the rotating shaft 76 and through which the rotating shaft 76 is inserted is formed in each of the pair of support portions 74. The rotational center R passes through the holes provided in the pair of support portions 74. In the extending direction J of the lever 81, a distance from the rotational center R to the end portion of the support portion 74 on the operation portion 73 side is longer than a distance from the rotational center R to the end portion of the support portion 74 on the point of application portion 75 side. In the extending direction P of the rotating shaft 76, in a state in which the pair of the support plate portions 85 of the support portion 72 are disposed between the pair of support portions 74, the rotating shaft 76 is inserted through each of the holes of the pair of support portions 74 and the pair of support plate portions 85. In this way, the lever 81 is rotatably supported on the main body portion 71.

The point of application portion 75 is provided on one end side (the rear left side) of the lever 81 with respect to the rotational center R (the rotating shaft 76). When the presser member 70 is disposed on the base frame 51, the point of application portion 75 can pivot between an upper side stand-by position in which the point of application portion 75 is more separated from the base frame 51 than the opposing surface 82, and a lower side application position in which the point of application portion 75 is closer to the base frame 51 than in the stand-by position. The point of application portion 75 is a corner portion of a portion of the lever 81 obtained by bending one end of the lever 81 upward. When the presser member 70 is disposed on the base frame 51, the point of application portion 75 faces the corresponding corner portion 524, among the four corner portions 524 of the opposing frame 52. The urging member 77 urges the lever 81 in a direction in which the point of application portion 75 pivots from the application position to the stand-by position. Thus, in a state in which an external pressure is not applied to the lever 81, the point of application portion 75 is positioned in the stand-by position.

Figure 11A:
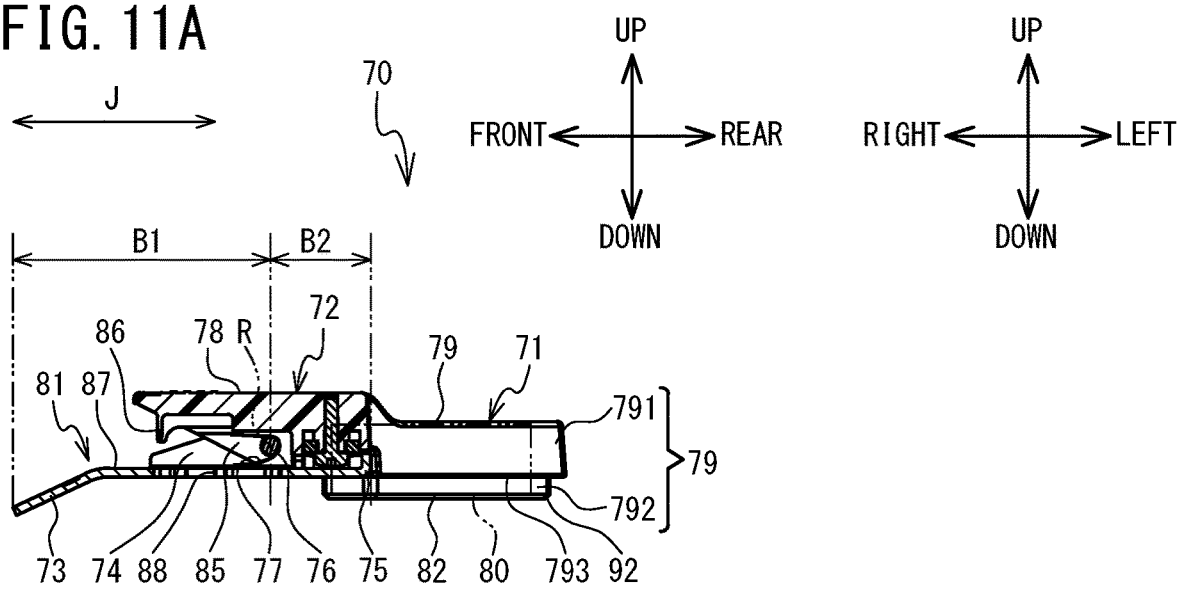
FIG. 11A is a cross-sectional view of the presser member in the direction of arrows along a line E-E shown in FIG. 4A, in a state in which a point of application portion is in a stand-by position.
Figure 11B:
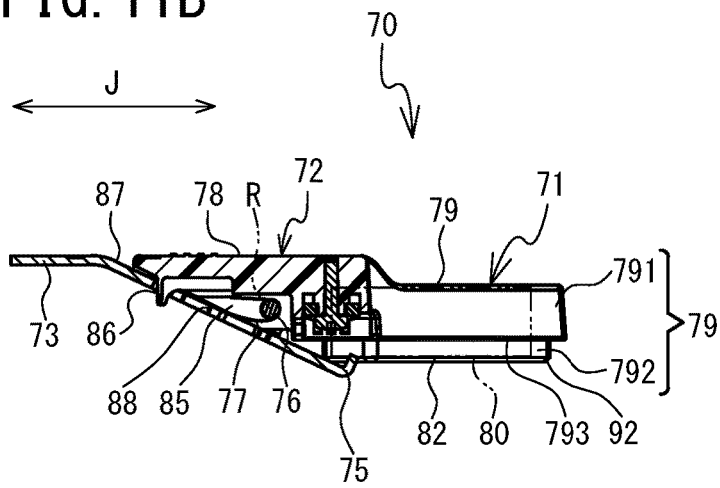
FIG. 11B is a cross-sectional view of the presser member in the direction of the arrows along the line E-E shown in FIG. 4A, in a state in which the point of application portion is in an application position.

As shown in FIG. 11A and FIG. 11B, in the extending direction J of the lever 81, the operation portion 73 is provided on another end side (the front right side) of the lever 81 with respect to the rotational center R (the rotating shaft 76), the other end side being the opposite side from the one end side. In the extending direction J of the lever 81, the operation portion 73 protrudes further to the other end side with respect to the rotational center R (the rotating shaft 76) of the lever 81 than the contact portion 78. When the operation portion 73 is moved upward by the user, the lever 81 rotates around the rotational center R of the rotating shaft 76, and the point of application portion 75 can move from the stand-by position to the application position. The operation portion 73 is bent downward with respect to the portion 87 between the rotational center R (the rotating shaft 76) and the operation portion 73. As shown in FIG. 11A, in the up-down direction, when the point of application portion 75 is in the stand-by position, the lower end portion of the operation portion 73 is positioned lower than the opposing surface 82. In the state in which the presser member 70 is disposed on the base frame 51, when the point of application portion 75 is in the stand-by position, in a plan view, as shown in FIG. 4B, the operation portion 73 is positioned on the opposite side from the opening 511 side with respect to the base frame 51 and the opposing frame 52. As shown in FIG. 9, the hole 88 is formed in substantially a center portion in the extending direction J of the lever 81. The hole 88 faces the convex portion 86 (refer to FIG. 10) of the bottom surface of the contact portion 78.

In the extending direction P of the rotating shaft 76, an extending range of the magnet 80 on the left side with respect to the support portion 72 is a range Q1, an extending range of the magnet 80 on the rear side with respect to the support portion 72 is a range Q2, and an extending range of the lever 81 is a range Q3. In the extending direction P of the rotating shaft 76, the ranges Q1 to Q3 are mutually different, and the range Q3 is between the range Q1 and the range Q2. In other words, in the extending direction P of the rotating shaft 76, the lever 81 is disposed between the pair of magnets 80.

In the extending direction J of the lever 81 that extends from the one end side to the other end side with respect to the rotational center R (the rotating shaft 76), an extending range of the operation portion 73 is a range K1, an extending range of the support portions 74 is a range K2, and an extending range of the magnets 80 is a range K3. The extending direction J of the lever 81 is a lengthwise direction of the lever 81. The point of application portion 75 is inside the range K3. Thus, in the extending direction J of the lever 81, of the point of application portion 75, the operation portion 73, and the support portions 74, at least the operation portion 73 and the support portions 74 are in positions different from the magnet 80.

As shown in FIG. 9 and FIG. 11A, in the extending direction J of the lever 81 according to the present embodiment, a first distance B1 to the rotating shaft 76 from an end of the lever 81 on the other end side (the operation portion 73 side) with respect to the rotational center R of the lever 81 (the rotating shaft 76) is longer than a second distance B2 to the rotating shaft 76 from the end of the lever 81 on the one end side (the point of application portion 75 side) with respect to the rotational center R of the lever 81 (the rotating shaft 76). The first distance B1 of the present embodiment is equal to or greater than 1.5 times the second distance B2.

As shown in FIG. 1 to FIG. 3, the mounting portion 55 can be coupled to the base frame 51, at the rear of the base frame 51 with respect to the opening 511, and can be removably mounted on the sewing machine 1. In a predetermined mounting position to be described later, the mounting portion 55 can be removably mounted using the frame attachment member 31 provided on the sewing machine 1. As shown in FIG. 3, the mounting portion 55 includes the attachment member 130, a positioning member 140, and a pair of left and right coupling portions 56. The attachment member 130 is a portion supported by the frame attachment member 31. The attachment member 130 is provided on the rear portion of the embroidery frame 5. The attachment member 130 is provided with a pair of left and right insertion portions 134, and a convex portion 137. The pair of left and right insertion portions 134 are formed by bending end portions in the left-right direction of the attachment member 130 upward, and include holes 138 that penetrate in the left-right direction. The convex portion 137 protrudes downward in the vicinity of the center, in the left-right direction, of the rear portion of the attachment member 130. The position of the convex portion 137 with respect to the attachment member 130 in the left-right direction is set to a position that is unique to the embroidery frame 5. The positioning member 140 is a member that defines the mounting position of the attachment member 130 with respect to the frame attachment member 31. The positioning member 140 extends in the left-right direction and is an elastic plate spring member. The positioning member 140 includes a pair of left and right gripping portions 142. The pair of left and right gripping portions 142 are provided on the left end and the right end of the positioning member 140, respectively. Each of the pair of left and right gripping portions 142 is a member that, when operating by the user, can move the position of the positioning member 140 in the up-down direction. As shown in FIG. 2 and FIG. 3, the pair of left and right gripping portions 142 are respectively inserted through the holes 138 in the attachment member 130. Each of the pair of left and right coupling portions 56 extends upward from the attachment member 130, between the pair of left and right insertion portions 134 in the left-right direction, and to the rear of the positioning member 140 in the front-rear direction.

As shown in FIG. 2, FIG. 3, FIG. 4A and FIG. 4B, the support member 60 supports the opposing frame 52 such that the opposing frame 52 can be displaced with respect to the base frame 51. The support member 60 is provided with a pair of left and right first members 61, a pair of left and right second members 62, and a shaft 63. Hereinafter, of the pair of left and right first members 61 and the pair of left and right second members 62, the configuration of the first member 61 and the second member 62 on the right side will be explained, and an explanation of the configuration of the first member 61 and the second member 62 on the left side will be omitted.

As shown in FIG. 4A, the first member 61 is plate-shaped and is bent into a reverse U shape in a plan view. As shown in FIG. 2, FIG. 3, FIG. 4A and FIG. 4B, the first member 61 is provided with a first section 41, and a third section 43. The first section 41 includes a first inclined section 611 and a coupling section 614. The first inclined section 611 extends upward and rearward (that is, extends diagonally upward and to the rear) with respect to the opening 511 of the base frame 51. The coupling section 614 is coupled to the mounting portion 55 at a position further to the rear than a support portion 64 to be described later. The coupling section 614 is a front right side end portion of the first member 61, and is fixed to the right coupling portion 56 of the mounting portion 55 by a screw 601. The third section 43 is provided with a section 612 that is parallel to an extending surface (a horizontal surface) of the base frame 51 and that extends in the left-right direction, and with a section 613 that is parallel to the extending surface of the base frame 51 and extends in the front-rear direction. The section 612 is coupled to the first section 41. The section 613 is coupled to a second section 42 to be described later. In other words, the third section 43 is coupled to the first section 41 and the second section 42 at a position higher than the support portion 64. A coupling section 44 that couples the first section 41 and the third section 43 according to the present embodiment is the rear end of the first inclined section 611, that is, the rear right end of the first member 61. As shown in FIG. 1 and FIG. 5, the coupling section 44 is further to the rear than the mounting portion 55. In a state in which the embroidery frame 5 is mounted on the sewing machine 1, the rear end portion of the coupling section 44 is positioned further to the rear than the holder 25.

As shown in FIG. 6, the second member 62 is a plate-shaped member bent into an obtuse angle in a right side view. As shown in FIG. 2, FIG. 3, FIG. 4A and FIG. 4B, the second member 62 is provided with the second section 42 and the support portion 64. The second section 42 includes a second inclined section 621 and a coupling section 622, and the front end portion of the second section 42 is coupled to the support portion 64. The second inclined section 621 extends upward and rearward (that is, extends diagonally upward and to the rear) with respect to the support portion 64. As shown in FIG. 1, in a right side view, the first inclined section 611 and the second inclined section 621 are inclined in a direction intersecting the base frame 51 while being substantially parallel to a shape of the rear end portion of the head portion 7 of the sewing machine 1. As shown in FIG. 2 and FIG. 4, the coupling section 622 extends rearward from the rear end of the second section 42 and substantially in parallel to the extending surface of the base frame 51. In the left-right direction, the coupling section 622 is disposed on the first inclined section 611 side (the right side) with respect to the section 613 of the first member 61, and the coupling section 622 is fixed to the right surface of the section 613 by screws 602 and 603. In this way, the second member 62 is fixed to the first member 61. The pair of second sections 42 are disposed between the pair of first sections 41 in the left-right direction.

Figure 7A:
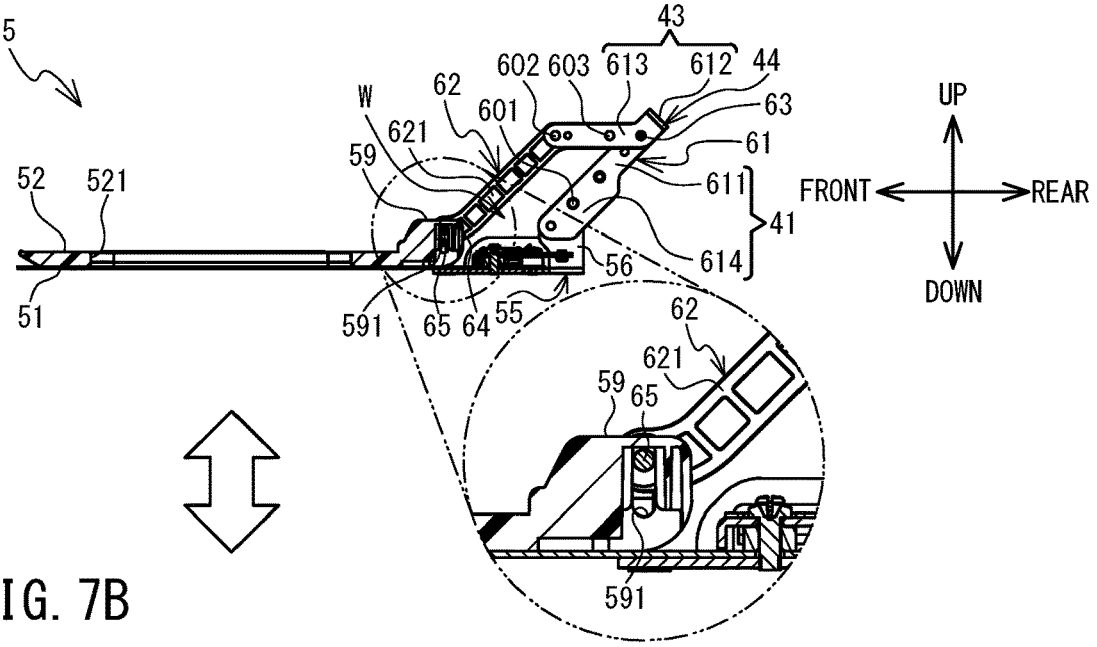
FIG. 7A is a view corresponding to a cross section in the direction of arrows along a line A-A shown in FIG. 4A when an opposing frame is in a lowered position and a closed position with respect to the base frame.
Figure 7B:
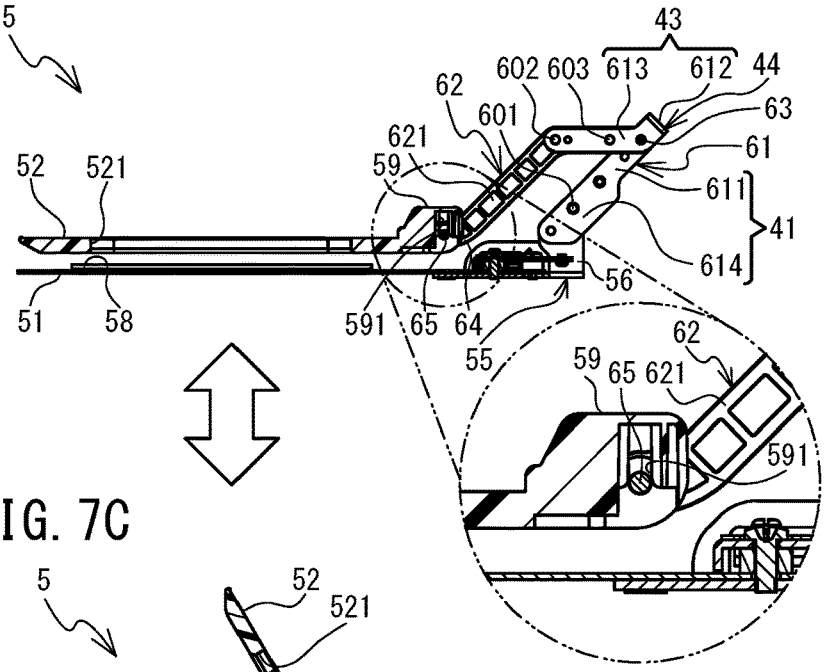
FIG. 7B is a view corresponding to the cross section in the direction of the arrows along the line A-A shown in FIG. 4A when the opposing frame is in a raised position and the closed position with respect to the base frame.
Figure 7C:
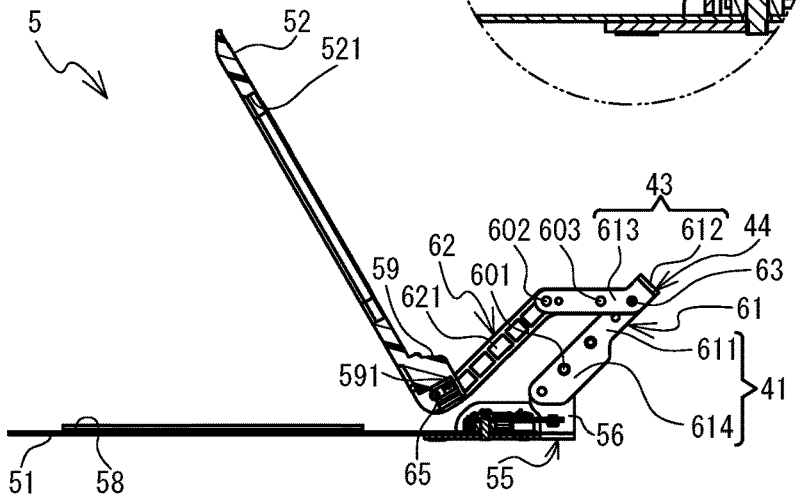
FIG. 7C is a view corresponding to the cross section in the direction of the arrows along the line A-A shown in FIG. 4A when the opposing frame is in a raised position and an open position with respect to the base frame.

The support portion 64 is the front end portion of the second member 62, and supports the opposing frame 52. The support portion 64 of the second member 62 on the left side is coupled to the left end of the shaft 65 that extends in the left-right direction, and the support portion 64 on the right side is coupled to the right end of the shaft 65. As shown in FIG. 7, the shaft 65 is inserted into the long hole 591 formed in the insertion portion 59 of the opposing frame 52. The support portion 64 supports the opposing frame 52 with respect to the base frame 51, such that the opposing frame 52 can move up and down between a lowered position shown in FIG. 7A and a raised position shown in FIG. 7B. As shown in FIG. 7A, when the opposing frame 52 is disposed in the lowered position with respect to the base frame 51, the upper surface of the base frame 51 and the bottom surface of the opposing frame 52 are in contact with each other. As shown in FIG. 7B, when the opposing frame 52 is disposed in the raised position and a closed position with respect to the base frame 51, the base frame 51 and the opposing frame 52 are disposed in parallel to each other, and the upper surface of the base frame 51 and the bottom surface of the opposing frame 52 are separated from each other. Further, the support portion 64 supports the opposing frame 52 with respect to the base frame 51 such that the opposing frame 52 can rotate between the closed position shown in FIG. 7B and an open position shown in FIG. 7C.

In the left-right direction, the front end portion of the first section 41 is preferably separated from the support portion 64. In the left-right direction, the front end portion of the first inclined section 611 is preferably in a position separated from the front end portion of the second inclined section 621. In the left-right direction, the front end portion of the first section 41 is preferably in a position separated by 5 mm or more from the support portion 64. In the left-right direction, the front end portion of the first section 41 is preferably in a position separated from the support portion 64 by 1/20 or more of the length, in the left-right direction, of the mounting portion 55. As shown in FIG. 4B, in the embroidery frame 5 of the present embodiment, the first inclined section 611 and the second inclined section 621 and separated from each other in the left-right direction, and extend substantially in parallel to each other in the front-rear direction. For example, a length D4 of the mounting portion 55 in the left-right direction is 160 mm, and a distance D1 from the front end portion of the first section 41 to the support portion 64 in the left-right direction is 22.2 mm, thus satisfying the conditions of being 5 mm or more, and being 1/20 or more of the length, in the left-right direction, of the mounting portion 55. In the front-rear direction, the front end portion of the first inclined section 611 and the support portion 64 corresponding to the first inclined section 611 are separated by a distance D2. In a plan view, the front end portion of the first inclined section 611 and the support portion 64 corresponding to the first inclined section 611 are separated by a distance D3 longer than the distance D2. As shown in FIG. 6, a space W encompassed by the first inclined section 611, the second inclined section 621, the coupling section 622, and the mounting portion 55 is a parallelogram in a right side view.

The shaft 63 is inserted through holes formed in the rear end portion of the first member 61 and the rear end portion of the second member 62, that is, the rear end portion of the first inclined section 611, the rear end portion of the coupling section 622, and the rear end portion of the section 613, and positions the first member 61 and the second member 62.

As shown in FIG. 2 and FIG. 3, the frame attachment member 31 is mainly provided with an attachment portion 32 and a switching plate 33. The embroidery frame 5 can be mounted on the attachment portion 32. The attachment portion 32 is mainly provided with an attachment member 34 and a pressing member 35. The attachment member 34 is a plate member that extends in the left-right direction. The attachment member 34 fixes the frame attachment member 31 to the holder 25 of the sewing machine 1 shown in FIG. 2, and also guides the movement of the switching plate 33. The pressing member 35 has a rectangular shape that is long in the left-right direction in a plan view. When the attachment member 130 of the embroidery frame 5 is positioned in the mounting position, the pressing member 35 is disposed above the attachment member 130, and urges the attachment member 130 to the attachment member 34 side (downward). When the gripping portions 142 are operated in the state in which the attachment member 130 is positioned in the mounting position, the pressing member 35 further urges the positioning member 140 in a removal direction. The removal direction is a movement direction of the attachment member 130 when the attachment member 130 is moved from the mounting position. The removal direction of the present embodiment is a direction opposite to a mounting direction, and is a direction from the rear toward the front. The pressing member 35 is fixed to the attachment member 34 by screws respectively inserted into through holes.

The switching plate 33 is a movement member that moves in the left-right direction in concert with an operation to mount the attachment member 130 of the embroidery frame 5 on the attachment portion 32, and is a member for which a movement amount is set in accordance with the type of the embroidery frame 5. The switching plate 33 is urged to the left by an urging member (not shown in the drawings). The switching plate 33 is provided with an engagement portion 37 provided extending upward in a hook shape from the rear left end portion of the switching plate 33. The engagement portion 37 engages with a detecting element that includes a rotary potentiometer (not shown in the drawings). The detecting element (not shown in the drawings) rotates in accordance with the movement amount of the switching plate 33. Thus, the rotary potentiometer can detect the movement amount of the switching plate 33 on the basis of a rotation amount of the detecting element. The sewing machine 1 can detect the type of the embroidery frame 5 on the basis of the rotation amount of the detecting element detected by the rotary potentiometer.

An operation to mount the embroidery frame 5 on the sewing machine 1 will be explained with reference to FIG. 2 and FIG. 3. The user inserts a pair of knob screws 39 into holes (not shown in the drawings) in the attachment member 34, and holes (not shown in the drawings) in the holder 25, and, by tightening the knob screws 39, attaches the frame attachment member 31 to the holder 25. When the embroidery frame 5 is mounted on the frame attachment member 31 mounted on the sewing machine 1, the user first horizontally moves the embroidery frame 5 in the mounting direction (to the rear). The convex portion 137 is housed in a predetermined position while being guided by the attachment member 34. At this time, depending on the position of the convex portion 137 with respect to the attachment member 34, the switching plate 33 moves to the right. When the user horizontally moves the embroidery frame 5 further in the mounting direction, the movement of the attachment member 130 in the horizontal direction is restricted, and the position of the embroidery frame 5 in the horizontal direction is fixed. Since the attachment member 130 is pressed from above by the pressing member 35, the attachment member 130 is held by the pressing member 35 and the attachment member 34. The position of the attachment member 130 is fixed in the up-down direction. As a result of the above operation, the embroidery frame 5 is mounted on the frame attachment member 31 of the sewing machine 1. The sewing machine 1 can detect the type of the embroidery frame 5 by detecting the movement amount of the switching plate 33 using the rotation amount of the detecting element.

When removing the embroidery frame 5 from the frame attachment member 31 mounted on the sewing machine 1, the user lifts up the gripping portions 142. When the gripping portions 142 are lifted upward, the positioning member 140 deflects, and is subject to a force in the removal direction from the pressing member 35. The attachment member 130 becomes able to move in the horizontal direction, and the user can smoothly move the embroidery frame 5 horizontally in the removal direction using the force in the removal direction from the pressing member 35. In other words, the user can easily remove the embroidery frame 5 from the mounting position.

Figure 8:
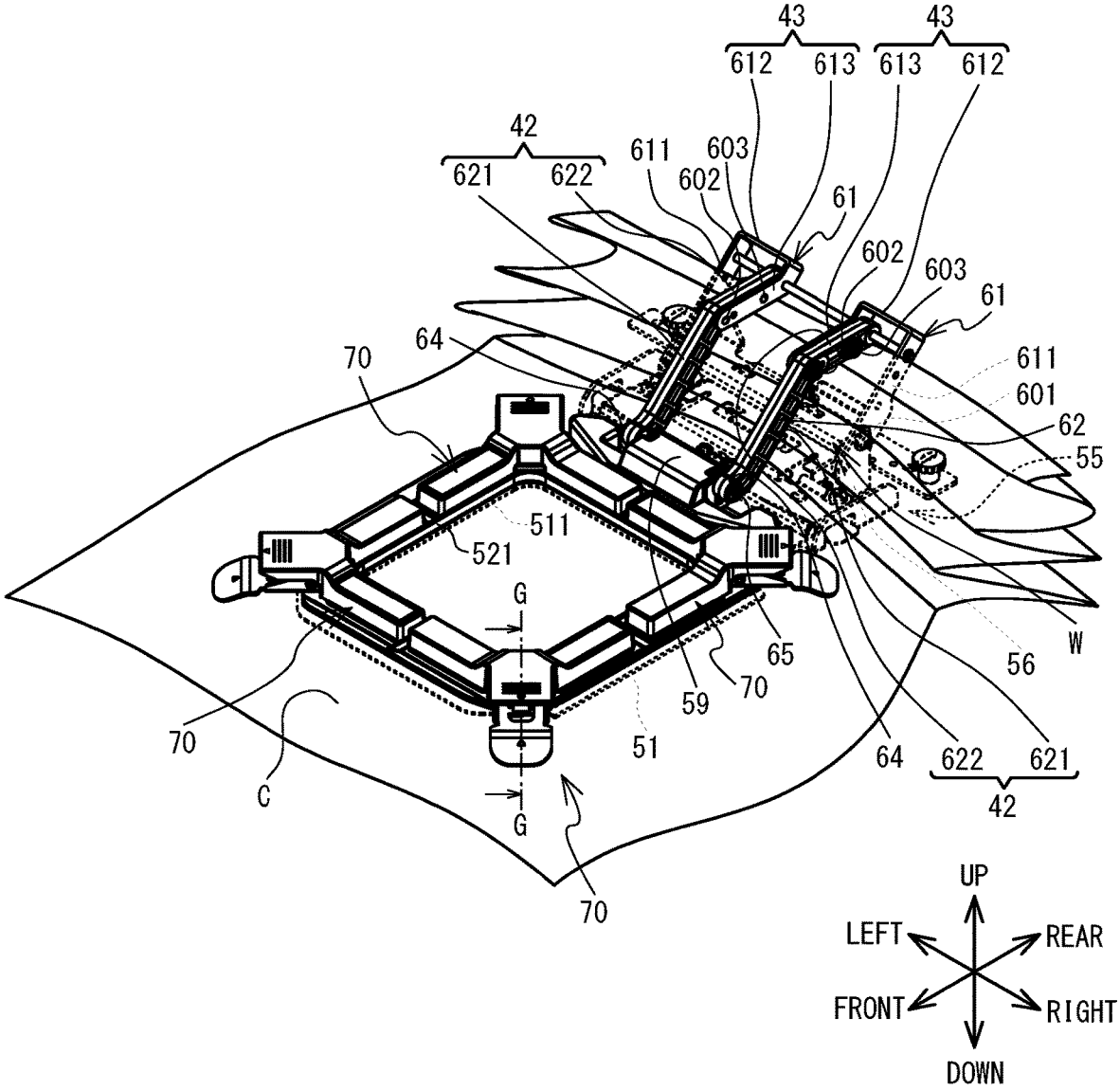
FIG. 8 is a perspective view of the embroidery frame in a state in which a sewing object is disposed between the base frame and the opposing frame

An operation to hold the sewing object C using the embroidery frame 5 will be explained with reference to FIG. 4A, FIG. 4B, FIG. 7A to FIG. 7C, and FIG. 8. When the user disposes the sewing object C on the embroidery frame 5, in a state in which the presser members 70 are retracted from the opposing frame 52, as shown in FIG. 4A, the user moves the opposing frame 52 from the lowered position shown in FIG. 7A to the raised position and the open position shown in FIG. 7C. The user disposes the sewing object C between the opposing frame 52 and the base frame 51. As shown in FIG. 8, of the end portions of the sewing object C that are not disposed between the opposing frame 52 and the base frame 51, as appropriate, the user disposes the end portion that is further to the rear than the opening 511 in the space W that, in the right side view, is encompassed by the first inclined section 611, the second inclined section 621, the coupling section 622 of the support member 60, and the mounting portion 55. In FIG. 8, the end portion of the sewing object C that is further to the rear than the opening 511 is disposed in the space W in a folded over manner in a bellows shape, but the end portion of the sewing object C may be rolled into a rolled-up shape and disposed in the space W, for example. When the end portion of the sewing object C is disposed in the space W so as to fill the space W, the portion of the sewing object C disposed in the space W comes into contact with the first inclined section 611, the second inclined section 621, the coupling section 622, and the mounting portion 55. At this time, in a lower portion inside the space W, the rear end portion of the end portion of the sewing object C comes into contact with the front end portion of the first section 41, and the front end portion of the end portion of the sewing object C comes into contact with the rear end of the support portion 64. Thus, as shown in the example in FIG. 4B, in the lower portion inside the space W, the sewing object C is disposed over a range between a curved line L1 and a curved line L2 in the front-rear direction. The curved line L1 passes through a position at which the front end portion of the first section 41 and the sewing object C come into contact with each other. The curved line L2 passes through a position at which the rear end of the support portion 64 and the sewing object C come into contact with each other. An interval in the front-rear direction between the curved line L1 and the curved line L2 is longer than the distance D2 between the front end portion of the first section 41 and the support portion 64. The user closes the opposing frame 52 with respect to the base frame 51. The user inserts the insertion portions 792 of the pair of housing portions 79 of the four presser members 70 into the corresponding holes 522 and 523, and disposes the presser members 70 with respect to the base frame 51. The four presser members 70 are guided, in accordance with the mounting position inside the opposing frame 52, by the partitioning portions 526 and 527, the pair of left and right guide portions 528, the front guide portion 529, and the rear guide portion 530, and the insertion portions 792 are inserted into the corresponding holes 522 and 523. With respect to the embroidery frame 5, in an arrangement state in which the sewing object C is disposed between the presser member 70, of which at least a part of the main body portion 71 is inserted into the holes 522 and 523 of the opposing frame 52, and the base frame 51, the presser member 70 presses the sewing object C to the base frame 51 side using the magnetic force.

When the user wishes to remove the presser member 70 from the state in which the presser member 70 is disposed on the base frame 51, the user hooks an operating body, such as a finger or the like, on the operation portion 73 and the contact portion 78 of the presser member 70, and moves the operation portion 73 to the contact portion 78 side (upward). In accordance with the operation portion 73 being operated upward in the state in which the presser member 70 is disposed on the base frame 51, the operation portion 73 resists the urging force of the urging member 77 and moves the point of application portion 75 from the stand-by position shown in FIG. 11A and FIG. 12A to the application position shown in FIG. 11B and FIG. 12B. When the operation portion 73 is moved upward by the user, of the lever 81, the portion 87 between the rotational center R (the rotating shaft 76) and the operation portion 73 comes into contact with the contact portion 78, and thus, the movement of the operation portion 73 is restricted and the movement is stopped. The convex portion 86 on the bottom surface of the contact portion 78 is inserted into the hole 88 of the lever 81 in the course of the lever 81 rotating in accordance with the operation of the operation portion 73. In the state in which the presser member 70 is disposed on the base frame 51, the point of application portion 75 faces the opposing frame 52, and, in accordance with the operation portion 73 being operated upward, the point of application portion 75 comes into contact with the opposing frame 52, and moves the main body portion 71 upward. More specifically, of the corner portions 524, the point of application portion 75 comes into contact with the corresponding corner portion 524 in the course of moving from the stand-by position to the application position, and, using the point of application portion 75 as the point of action, the support portion 72 is lifted upward using the principle of leverage. In the lever 81 according to the present embodiment, the first distance B1 is longer than the second distance B2. Thus, the user can lift the support portion 72 upward with a relatively small force. In this way, as shown in FIG. 12B, the operation portion 73 resists the magnetic force of the magnet 80 and causes at least a part of the main body portion 71, that is, of the support portion 72 and the pair of housing portions 79, a section coupled to the support portion 72, to move upward. In a state in which the lever 81 is in contact with the contact portion 78, the upper surface of the operation portion 73 extends in parallel with the upper surface of the contact portion 78 so as to be substantially in the same plane. By lifting up the presser member 70 using, as the point of action, end portions of the pair of housing portions 79 on a side separated from the support portion 72, that is, a lower end portion 91 on the rear side of the housing portion 79 with respect to the support portion 72 and a lower end portion 92 (refer to FIG. 9 and FIG. 11B) on the left side of the housing portion 79 on the left side with respect to the support portion 72, the user can remove the presser member 70 from the base frame 51 with a small force compared to when removing the presser member 70 by gripping the main body portion 71.

The embroidery frame 5 of the above-described embodiment is provided with the base frame 51 that includes the magnetic body, and the presser members 70 that, using the magnetic force, press the sewing object C disposed between the base frame 51 and the presser members 70 to the base frame 51 side. The presser member 70 includes the opposing surface 82 that faces the base frame 51, the main body portion 71 that includes the magnet 80, and the lever 81. The lever 81 is provided with the support portions 74, the point of application portion 75, and the operation portion 73. The support portions 74 is supported by the main body portion 71 such that the support portion 74 can rotate around the rotating shaft 76. The point of application portion 75 is provided on the one end side of the lever 81 with respect to the rotational center R of the lever 81, and, when the presser member 70 is disposed on the base frame 51, the point of application portion 75 can pivot between the upper side stand-by position in which the point of application portion 75 is more separated from the base frame 51 than the opposing surface 82, and the lower side application position in which the point of application portion 75 is closer to the base frame 51 than in the stand-by position. The operation portion 73 is provided on the other end side of the lever 81 that is the opposite side from the one end side, with respect to the rotational center R of the lever 81. In accordance with the operation portion 73 being operated upward in the state in which the presser member 70 is disposed on the base frame 51, the operation portion 73 moves the point of application portion 75 from the stand-by position to the application position, and moves at least a part of the main body portion 71 upward in resistance to the magnetic force of the magnet 80. As a result of including the base frame 51 and the presser member 70, and as a result of the presser member 70 pressing the sewing object C disposed between the base frame 51 and the presser member 70 to the base frame 51 side using the magnetic force, the embroidery frame 5 can clamp the sewing object C between the base frame 51 and the presser member 70. When removing the sewing object C from the embroidery frame 5, the user moves the operation portion 73 upward. In this way, the point of application portion 75 is moved from the stand-by position to the application position, and, as a result of the point of application portion 75 pressing the base frame 51 downward via the sewing object C clamped between the main body portion 71 and the base frame 51, or pressing the base frame 51 downward without the sewing object C, the main body portion 71 is moved upward in resistance to the magnetic force of the magnet 80. The embroidery frame 5 can hold the sewing object C disposed between the base frame 51 and the presser member 70 using the magnetic force of the magnet 80 provided in the presser member 70, and, further, the operation to remove the presser member 70 from the base frame 51 is easier than in known art.

In the embroidery frame 5, when the point of application portion 75 is in the application position, the point of application portion 75 is lower than the opposing surface 82. Since the point of application portion 75 is lower than the opposing surface 82 when the point of application portion 75 is in the application position, with a relatively simply configuration, the embroidery frame 5 can move the main body portion 71 upward in resistance to the magnetic force of the magnet 80, in accordance with the operation portion 73 being operated upward.

In the embroidery frame 5, in the extending direction J of the lever 81 that extends from the one side to the other end side of the support portion 74, of the point of application portion 75, the operation portion 73, and the rotational center R, at least the operation portion 73 and the rotational center R are in different positions from the magnet 80. In the embroidery frame 5, in the extending direction J of the lever 81, the support portions 74 are also in different positions from the magnet 80. With the embroidery frame 5, the presser member 70 can be removed from the base frame 51 using a weaker force than a case in which at least one of the operation portion 73 and the rotational center R is in a position overlapping with magnet 80 in the extending direction J of the lever 81.

In the embroidery frame 5, the first distance B1 to the rotational center R from the end of the lever 81 on the other end side (the operation portion 73 side) with respect to the rotational center R of the lever 81 is longer than the second distance B2 to the rotational center R from the end of the lever 81 on the one end side (the point of application portion 75 side) with respect to the rotational center R of the lever 81. Using the principle of leverage, the embroidery frame 5 can move the point of application portion 75 from the stand-by position to the application position with a relatively small force.

The embroidery frame 5 is provided with the opposing frame 52 that faces the base frame 51 and in which the holes 522 and 523 are formed. In an arrangement state in which the sewing object C is disposed between the presser member 70, of which at least a part of the main body portion 71 is inserted into the holes 522 and 523 of the opposing frame 52, and the base frame 51, the presser member 70 presses the sewing object C to the base frame 51 side using the magnetic force. In the arrangement state, the point of application portion 75 faces the opposing frame 52, and, in accordance with the operation portion 73 being operated upward, the point of application portion 75 comes into contact with the opposing frame 52 and moves the main body portion 71 upward. As a result of this, when removing the sewing object C from the embroidery frame 5, the point of application portion 75 does not come into contact with the sewing object C and the embroidery frame 5 can inhibit the point of application portion 75 from damaging the sewing object C.

The embroidery frame 5 is provided with the support member 60 that positions the opposing frame 52 with respect to the base frame 51. The support member 60 is coupled to the base frame 51 and rotatably supports the opposing frame 52 with respect to the base frame 51. Compared to the embroidery frame 5 that does not include the opposing frame 52, the embroidery frame 5 easily positions the presser member 70 with respect to the base frame 51. Compared to the embroidery frame 5 in which a positioning member is not coupled to the base frame 51 and does not rotatably support the opposing frame 52 with respect to the base frame 51, with the embroidery frame 5, the operation to position the opposing frame 52 with respect to the base frame 51 is easier.

The embroidery frame 5 is provided with the urging member 77 that urges the lever 81 in a direction such that the point of application portion 75 pivots from the application position to the stand-by position. In accordance with the operation portion 73 being operated upward, the operation portion 73 move the point of application portion 75 from the stand-by position to the application position in resistance to the urging force of the urging member 77. The embroidery frame 5 can reduce an amount of time and effort for the user to move the point of application portion 75 from the application position to the stand-by position.

The main body portion 71 of the presser member 70 is provided with the contact portion 78 on the opposite side from the opposing frame 52 with respect to the magnet 80. When the operation portion 73 protrudes, with respect to the rotational center R of the lever 81, further to the other end side than the contact portion 78, and is moved upward, the portion 87 between the rotational center R of the lever 81 and the operation portion 73 comes into contact with the contact portion 78 and the movement of the operation portion 73 is restricted. When removing the sewing object C from the embroidery frame 5, the user grips the contact portion 78 and the operation portion 73, and applies a force in a direction to move the operation portion 73 upward, that is, to cause the distance between the contact portion 78 and the operation portion 73 to become smaller. When the point of application portion 75 moves to the application position, of the main body portion 71, the contact portion 78 moves upward. By using the end portion of the main body portion 71 on the point of application portion 75 side with respect to the rotational center R of the lever 81 as a fulcrum, and moving the contact portion 78 further upward, the user can separate the presser member 70 from the base frame 51 with a relatively small force.

The operation portion 73 is bent downward with respect to the portion 87 between the rotational center R of the lever 81 and the operation portion 73. In a state in which the lever 81 is in contact with the contact portion 78, the upper surface of the operation portion 73 extends in parallel with the surface of the contact portion 78. The embroidery frame 5 can improve operability when the user operates the operation portion 73 upward.

When the point of application portion 75 is in the stand-by position, of the operation portion 73, the lower end portion of the operation portion 73 is positioned lower than the opposing surface 82 in the up-down direction. The embroidery frame 5 can make the size of the main body portion 71 in the up-down direction relatively small, while stretching the distance from the support portion 74 of the lever 81 to the end of the operation portion 73 on the other end side.

The main body portion 71 includes the pair of magnets 80. The lever 81 is disposed between the pair of magnets 80 in the extending direction P of the rotating shaft 76. As a result of the operation portion 73 being operated upward, the embroidery frame 5 can move a part of the main body portion 71 upward in resistance to the magnetic force of the pair of magnets 80. Compared to a case in which the lever 81 is not disposed between the pair of magnets 80 in the extending direction P of the rotating shaft 76, with the embroidery frame 5, the presser member 70 is more easily balanced in the extending direction P of the rotating shaft 76 when removing the sewing object C from the embroidery frame 5.

An embroidery frame and a sewing machine according to the present disclosure are not limited to the above-described embodiment, and various modifications may be added insofar as they do not depart from the gist and spirit of the present disclosure. For example, the following modifications may be added. The configuration of the embroidery frame 5, the embroidery frame unit 30, the sewing machine 1 may be changed as appropriate. The number of the needle bars 22 provided in the sewing machine 1 may be any number as long as it is one or greater. A configuration may be adopted in which one or more types of the embroidery frame can be mounted on the sewing machine 1. The embroidery frame 5 may have a configuration to be directly mounted on the holder 25 of the sewing machine 1. When the embroidery frame 5 is attached to the sewing machine 1 via the frame attachment member 31, the configuration of the frame attachment member 31 may be changed as appropriate.

A size, a plan view shape, a thickness, and the like of the embroidery frame 5 may be changed as appropriate. An inner edge of each of the base frame 51 and the opposing frame 52 may be a shape other than a polygonal shape, such as a circular shape, an elliptical shape, and the like. When the inner edge of each of the base frame 51 and the opposing frame 52 is the polygonal shape, it may be a shape other than a square, such as a triangular shape, a rectangular shape, a pentagonal shape, and the like.

The embroidery frame 5 need not necessarily be provided with the opposing frame 52 and the support member 60. In this case, the embroidery frame 5 may clamp the sewing object C using the base frame 51 and the presser member 70 by directly disposing the presser member 70 on the sewing object C disposed on the base frame 51. When the embroidery frame 5 is provided with the opposing frame 52, the embroidery frame 5 may omit the support member 60, or the configuration of the support member 60 may be changed.

When the embroidery frame 5 omits the support member 60, the opposing frame 52 is disposed as appropriate on the sewing object C disposed on the base frame 51. At this time, the user may use the pair of left and right bent portions 58 of the base frame 51 for determining the position of the opposing frame 52 in the left-right direction with respect to the base frame 51, for example. The base frame 51 may be provided with a pair of front and rear bent portions in a similar manner to the pair of left and right bent portions 58, and at this time, the user may use the pair of left and right bent portions 58 and the pair of front and rear bent portions of the base frame 51 for determining the position of the opposing frame 52 with respect to the base frame 51 in the left-right direction and in the front-rear direction.

Figure 13:
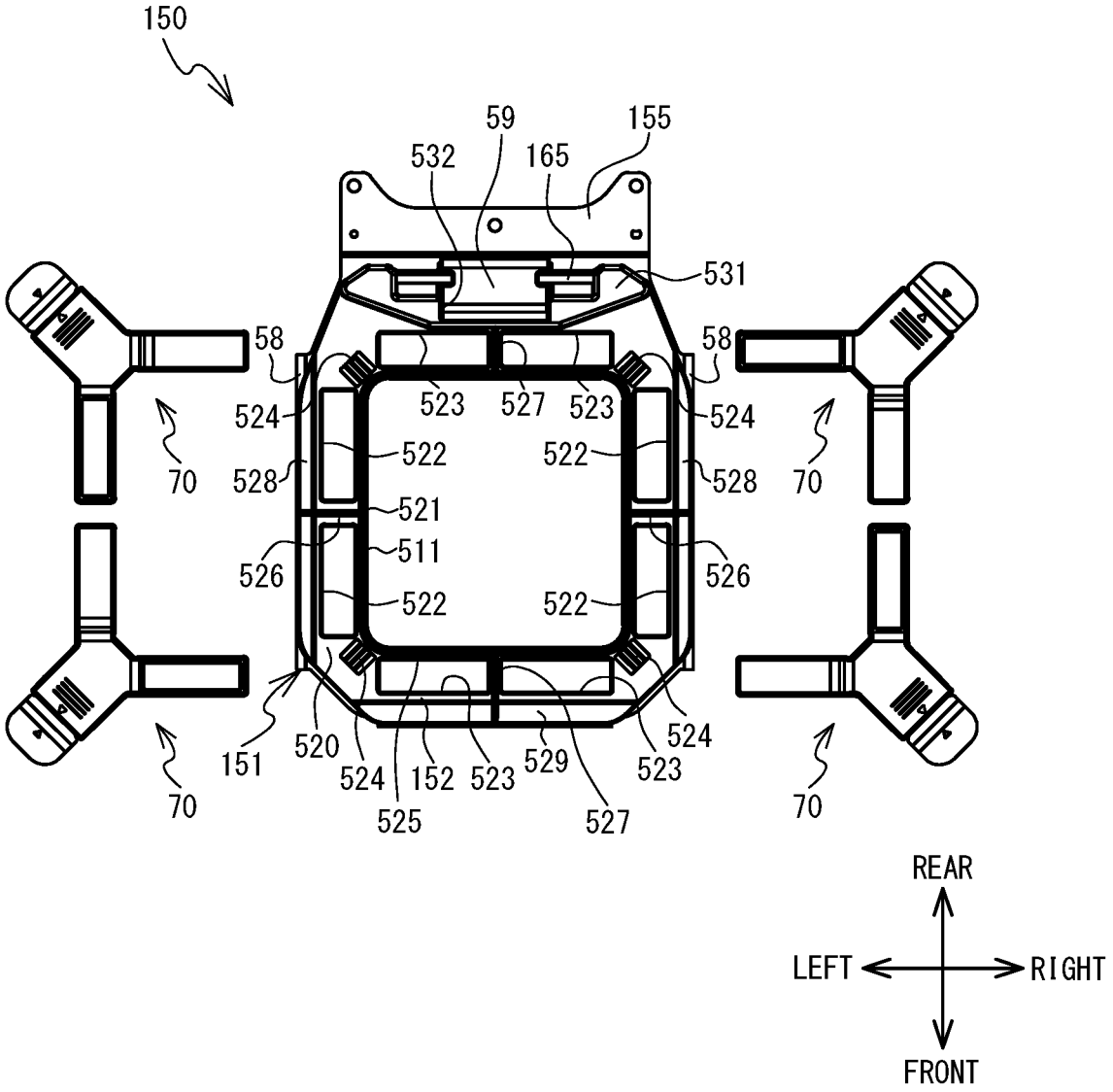
FIG. 13 is a perspective view of an embroidery frame according to a modified example.

Hereinafter, an embroidery frame 150 in which the support member 60 has been omitted from the embroidery frame 5 will be explained. In FIG. 13, the same reference signs will be assigned to the configuration elements that are the same as those of the embroidery frame 5 of the above-described embodiment. As shown in FIG. 13, the embroidery frame 150 according to a modified example is not provided with the support member 60 of the embroidery frame 5, and is provided with a base frame 151, an opposing frame 152, a mounting portion 155, and the four presser members 70. The base frame 151 is coupled to the mounting portion 155 at the rear end portion of the base frame 151. The basic configuration of the base frame 151 is the same as that of the base frame 51, and the opening 511 is formed therein, and the base frame 151 includes the bent portions 58 on both the left and right end portions. The rear end portion of the base frame 151 is provided with the insertion portion 59 that is provided on the opposing frame 52 in the embroidery frame 5. The insertion portion 59 includes the long hole 591 (refer to FIG. 5) that penetrates in the left-right direction. The basic configuration of the opposing frame 152 is the same as that of the opposing frame 52, and the two sets of the pairs of holes 522 and the two sets of the pairs of holes 523 that penetrate in the up-down direction are formed in the opposing frame 152. The opposing frame 152 is provided with the upper surface 520, the four corner portions 524, the wall portion 525, the pair of left and right partitioning portions 526, the pair of front and rear partitioning portions 527, the pair of left and right guide portions 528, the front guide portion 529, and a rear guide portion 531. The rear guide portion 531 extends in the left-right direction at the rear end portion of the opposing frame 152, is provided standing upward from the upper surface 520 of the opposing frame 152, and is provided with a recessed portion 532 that is recessed from the rear toward the front in a plan view. The insertion portion 59 of the base frame 151 is disposed in the recessed portion 532. The rear guide portion 531 holds both ends of a shaft 165 that extends in the left-right direction and that is inserted into the long hole 591 of the insertion portion 59. In this way, the position of the opposing frame 152 with respect to the base frame 151 is determined in the front-rear direction and the left-right direction, and the opposing frame 152 is rotatably supported with respect to the base frame 151.

The configuration of the presser member 70 may be changed as appropriate in accordance with the shape, size, and the like of the embroidery frame 5. It is sufficient that the presser member 70 be provided with one or more of the magnets 80, and the shape, size, number, and arrangement of the magnets 80 may be changed as appropriate. In the state in which the presser member 70 is disposed with respect to the base frame 51, the point of application portion 75 of the presser member 70 need not necessarily face the opposing frame 52, and may face the sewing object C or the base frame 51. In the state in which the presser member 70 is disposed with respect to the base frame 51, when the point of application portion 75 of the presser member 70 faces the corner portion 524 of the opposing frame 52, the corner portion 524 may protrude further upward than the upper surface 520 of the opposing frame 52. In this kind of case, the lower end of the point of application portion 75 when the point of application portion 75 is in the application position need not necessarily be positioned lower than the opposing surface 82 of the housing portion 79. In the extending direction J of the lever 81, the operation portion 73 need not necessarily protrude from the contact portion 78. When the point of application portion 75 is in the stand-by position, the lower end portion of the operation portion 73 may be in the same position as the opposing surface 82, or may be positioned higher than the opposing surface 82 in the up and down direction. The operation portion 73 may bend upward with respect to the portion 87 between the rotational center R of the lever 81 and the operation portion 73, or need not necessarily bend with respect to the portion 87. In the state in which the lever 81 is in contact with the contact portion 78, the upper surface of the operation portion 73 may extend in parallel with the upper surface of the contact portion 78, or may extend in a direction intersecting the upper surface of the contact portion 78. The contact portion 78 of the presser member 70 may be omitted. In the extending direction J of the lever 81, each of the operation portion 73, the rotational center R (the rotating shaft 76), and the support portions 74 may be in the same position as the magnet 80, or, in addition to the operation portion 73 and the support portions 74, the point of application portion 75 may also be in a mutually different position to the magnet 80. The range Q1 and the range Q3 may be partially or wholly overlapping. The range Q2 and the range Q3 may be partially or wholly overlapping. In other words, in the extending direction P of the rotating shaft 76, the lever 81 may be disposed in a position overlapping with the magnet 80. The first distance B1 and the second distance B2 may be the same as each other, or the first distance B1 may be shorter than the second distance B2. The presser member 70 need not necessarily be provided with the urging member 77. When the presser member 70 is provided with the plurality of magnets 80, the lever 81 need not necessarily be disposed between the plurality of magnets 80 in the extending direction P of the rotating shaft 76. It is sufficient that the main body portion 71 of the presser member 70 be able to support the lever 81 at the support portions 74 such that the lever 81 can rotate around the rotational center R, and a configuration to rotatably support the lever 81 may be changed as appropriate. For example, the main body portion 71 need not necessarily be provided with the rotating shaft 76, and in this case, for example, centering on the rotational center R, the support portion 74 may be provided with a cylindrically shaped, columnar shaped, or polygonal shaped convex portion that extends along the rotational center R, and, as a result of the convex portion being inserted into a circular hole inscribed in a convex portion provided on the main body portion 71, the main body portion 71 may support the lever 81 so as to be rotatable around the rotational center R.

Figure 14:
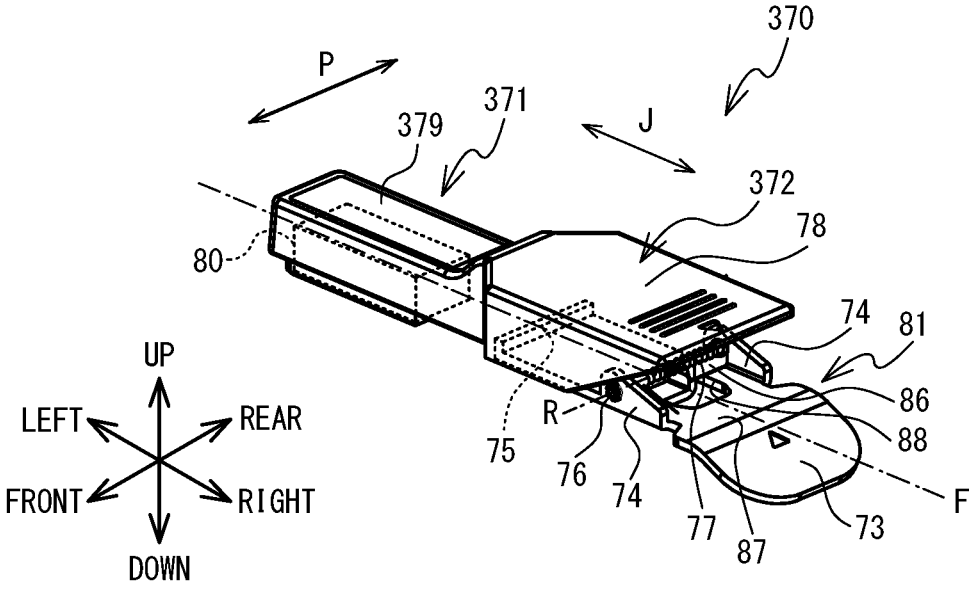
FIG. 14 is a perspective view of the presser member according to a modified example.
Figure 15:
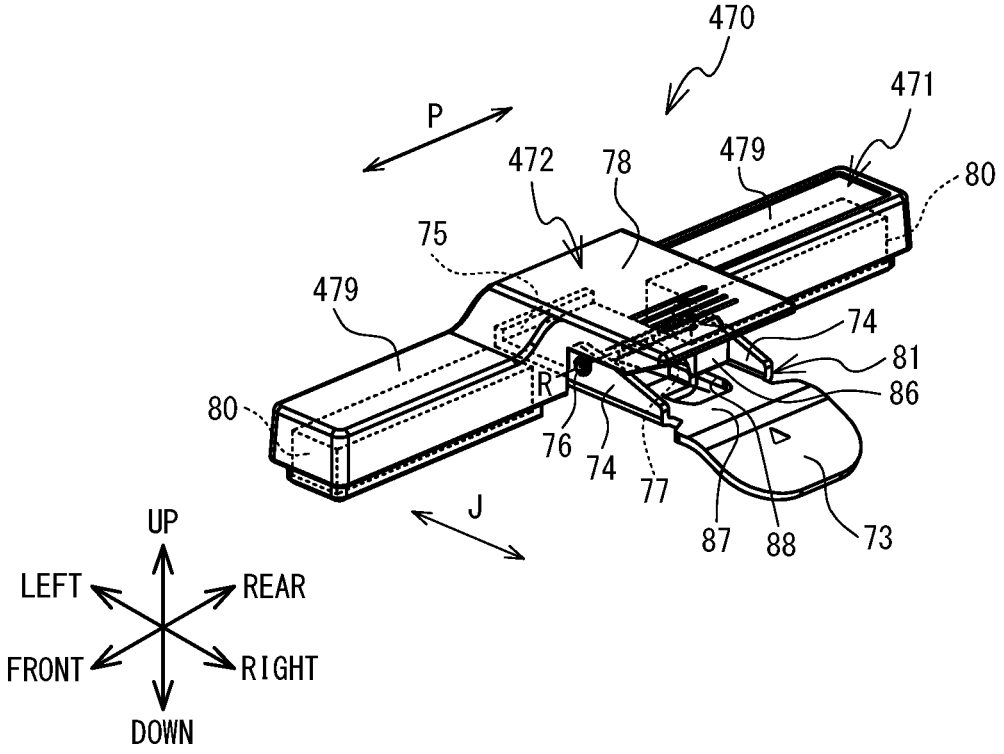
FIG. 15 is a perspective view of the presser member according to a modified example.

Hereinafter, configurations of presser members 370 and 470 having a difference configuration from the presser member 70 will be described in order. In FIG. 14 and FIG. 15, the same reference signs will be assigned to the configuration elements that are the same as those of the presser member 70 of the above-described embodiment. As shown in FIG. 14, the presser member 370 is provided with a main body portion 371 and the lever 81 that is the same as in the presser member 70. The main body portion 371 has an I shape in a plan view. The main body portion 371 is provided with a housing portion 379, the magnet 80 and a support portion 372. The main body portion 371 is a cuboid shape that is long in the left-right direction. The housing portion 379 houses the magnet 80. The support portion 372 is coupled to the right end of the housing portion 379. The support portion 372 is provided with the same contact portion 78 as the support portion 72, a pair of support plate portions (not shown in the drawings), the rotating shaft 76, the urging member 77, and the convex portion 86. The lever 81 is provided with the pair of support portions 74, the point of application portion 75, the operation portion 73, the portion 87, and the hole 88. In the extending direction P of the rotating shaft 76, the magnet 80, the point of application portion 75, and the operation portion 73 are disposed in positions in which extending ranges thereof partially overlap. In other words, in a plan view, the magnet 80, the point of application portion 75, and the operation portion 73 are positioned on a straight line F that extends in the extending direction J of the lever 81. Thus, the presser member 370 is more easily balanced in the extending direction P of the rotating shaft 76 when removing the sewing object C from the embroidery frame 5.

As shown in FIG. 15, the presser member 470 is provided with a main body portion 471, and the lever 81 that is the same as in the presser member 70. The main body portion 471 has a T shape in a plan view. The main body portion 471 is provided with a pair of front and rear housing portions 479, a pair of the magnets 80, and a support portion 472. Each of the pair of front and rear housing portions 479 is a cuboid shape that is long in the front-rear direction. Each of the housing portions 479 houses the magnet 80. The support portion 472 is coupled to the rear end of the front side housing portion 479 and to the front end of the rear side housing portion 479. The support portion 472 is provided with the contact portion 78 that is the same as in the support portion 72, a pair of support plate portions (not shown in the drawings), the rotating shaft 76, the urging member 77, and the convex portion 86. The lever 81 is provided with the pair of support portions 74, the point of application portion 75, the operation portion 73, the portion 87, and the hole 88. In the extending direction P of the rotating shaft 76, the lever 81 is disposed between the pair of magnets 80. Compared to a case in which the lever 81 is not disposed between the pair of magnets 80 in the extending direction P of the rotating shaft 76, in a similar manner to the presser member 70, the presser member 470 is more easily balanced in the extending direction P of the rotating shaft 76 when removing the sewing object C from the embroidery frame 5.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery frame comprising:

a base frame including a magnetic body;

a presser member configured to press a sewing object disposed between the presser member and the base frame toward the base frame, using a magnetic force, the presser member including:

a main body portion including an opposing surface facing the base frame and a magnet; and a lever being provided with:

a support portion being rotatably supported on the main body portion to rotate around a rotational center;

a point of application portion provided on one end side of the lever in a lengthwise direction of the lever with respect to the rotational center, the lengthwise direction intersecting an extending direction of the rotational center, the point of application portion being pivotable to a stand-by position and an application position when the presser member is disposed on the base frame, the stand-by position being a position where the point of application portion is on a first side, in a orthogonal direction orthogonal to the opposing surface, separated further from the base frame than the opposing surface, the application position being a position where the point of application portion is on a second side, in the orthogonal direction, closer to the base frame than in the stand-by position; and an operation portion provided on another end side of the lever with respect to the rotational center, the other end side being the opposite side from the one end side in the lengthwise direction of the lever, the operation portion moving the point of application portion from the stand-by position to the application position in accordance with the operation portion being operated to the first side in a state where the presser member is disposed on the base frame, to move at least a part of the main body portion to the first side in resistance to a magnetic force of the magnet, when the lever is in the stand-by position the opposing surface faces the base frame, and when the lever is in the application position the opposing surface faces the base frame; and an opposing frame in which a hole is formed, the opposing frame facing the base frame, wherein in an arrangement state where the sewing object is disposed between the base frame and the presser member, at least a part of the main body portion of the presser member being inserted into the hole of the opposing frame, the presser member presses the sewing object toward the base frame using the magnetic force, and in the arrangement state, the point of application portion faces the opposing frame, and, in accordance with the operation portion being operated to the first side, comes into contact with the opposing frame and moves the main body portion to the first side.

2. The embroidery frame according to claim 1, wherein when the point of application portion is in the application position, the point of application portion is further to the second side than the opposing surface.

3. The embroidery frame according to claim 1, wherein in an extending direction of the lever extending from the one end side to the other end side of the support portion, of the point of application portion, the operation portion, and the rotational center, at least the operation portion and the rotational center are in different positions from the magnet.

4. The embroidery frame according to claim 1, wherein a first distance to the rotational center from an end of the lever on the other end side with respect to the rotational center is longer than a second distance to the rotational center from an end of the lever on the one end side with respect to the rotational center.

5. The embroidery frame according to claim 1, further comprising:

a positioning member coupled to the base frame, the positioning member rotatably supporting the opposing frame with respect to the base frame to position the opposing frame with respect to the base frame.

6. The embroidery frame according to claim 1, further comprising:

a spring urging the lever in a direction to pivot the point of application portion from the application position to the stand-by position, wherein in accordance with the operation portion being operated to the first side, the operation portion moves the point of application portion from the stand-by position to the application position in resistance to an urging force of the spring.

7. The embroidery frame according to claim 1, wherein the main body portion is provided with a contact portion on an opposite side in the orthogonal direction with respect to the magnet in the orthogonal direction, the contact portion being between the operation portion and the rotational center in the lengthwise direction of the lever, and when the operation portion is operated to the first side, a section between the rotational center and the operation portion comes into contact with the contact portion and movement of the operation portion is restricted.

8. The embroidery frame according to claim 7, wherein the operation portion is bent with respect to the section between the rotational center and the operation portion, and a largest surface of the operation portion extends in parallel to a largest surface of the contact portion, in a state where the lever is in contact with the contact portion.

9. The embroidery frame according to claim 1, wherein when the point of application portion is in the stand-by position, an end portion of the operation portion on the second side is positioned further to the second side than the opposing surface.

10. The embroidery frame according to claim 1, wherein the main body portion includes a pair of the magnets, and the lever is disposed between the pair of magnets in an extending direction of the rotational center.

11. The embroidery frame according to claim 1, wherein the magnet, the point of application portion, and the operation portion are disposed on a same straight line in the lengthwise direction of the lever.

12. A presser member pressing a sewing object disposed between the presser member and a base frame including a magnetic body toward the base frame, using a magnetic force, the presser member comprising:

a main body portion including an opposing surface facing the base frame and a magnet;

a lever being provided with:

a support portion being rotatably supported on the main body portion to rotate around a rotational center;

a point of application portion provided on one end side of the lever in a lengthwise direction of the lever with respect to the rotational center, the lengthwise direction intersecting an extending direction of the rotational center, the point of application portion being pivotable to a stand-by position and an application position when the presser member is disposed on the base frame, the stand-by position being a position where the point of application portion is on a first side, in a orthogonal direction orthogonal to the opposing surface, separated further from the base frame than the opposing surface, the application position being a position where the point of application portion is on a second side, in the orthogonal direction, closer to the base frame than in the stand-by position; and an operation portion provided on another end side of the lever with respect to the rotational center, the other end side being the opposite side from the one end side in the lengthwise direction of the lever, the operation portion moving the point of application portion from the stand-by position to the application position in accordance with the operation portion being operated to the first side in a state where the presser member is disposed on the base frame, to move at least a part of the main body portion to the first side in resistance to a magnetic force of the magnet, when the lever is in the stand-by position the opposing surface faces the base frame, and when the lever is in the application position the opposing surface faces the base frame; and an opposing frame in which a hole is formed, the opposing frame facing the base frame, wherein in an arrangement state where the sewing object is disposed between the base frame and the presser member, at least a part of the main body portion of the presser member being inserted into the hole of the opposing frame, the presser member presses the sewing object toward the base frame using the magnetic force, and in the arrangement state, the point of application portion faces the opposing frame, and, in accordance with the operation portion being operated to the first side, comes into contact with the opposing frame and moves the main body portion to the first side.

* * * * *